US006374791B1

(12) United States Patent
Kuwabara et al.

(10) Patent No.: US 6,374,791 B1
(45) Date of Patent: Apr. 23, 2002

(54) ENGINE STARTING DEVICE

(75) Inventors: Shigeaki Kuwabara; Kazumi Miyashita, both of Wako; Keizo Shimizu; Taro Kihara, both of Takasaki, all of (JP)

(73) Assignees: Honda Giken Kogyo Kabushiki Kaisha; Starting Industrial Co., Ltd., both of (JP)

( * ) Notice: Subject to any disclaimer, the term of this patent is extended or adjusted under 35 U.S.C. 154(b) by 71 days.

(21) Appl. No.: 09/634,001

(22) Filed: Aug. 7, 2000

(30) Foreign Application Priority Data

Aug. 6, 1999 (JP) ..... 11-224648
Aug. 6, 1999 (JP) ..... 11-224653
Aug. 6, 1999 (JP) ..... 11-224657

(51) Int. Cl.[7] ..... F02N 17/00
(52) U.S. Cl. ..... 123/179.25; 123/179.24
(58) Field of Search ..... 123/179.24, 179.28, 123/179.26, 179.25; 74/7 A, 7 C; 192/42, 41 R

(56) References Cited

U.S. PATENT DOCUMENTS 4,848,288 A * 7/1989 Murase et al. ..... 123/179 P
4,922,868 A * 5/1990 Ohkanda ..... 123/179 P

FOREIGN PATENT DOCUMENTS

JP 2108854 4/1990

* cited by examiner

*Primary Examiner*—Bibhu Mohanty
(74) *Attorney, Agent, or Firm*—Adams & Wilks

(57) ABSTRACT

An engine starting device includes a self-starting motor drivable to rotate the crankshaft of an engines, and a one-way clutch operable to permit transmission of rotary motion of the self-starting motor in one direction only to the crankshaft. The one-way clutch includes an inner race operatively connected to an output shaft of the self-starting motor, an outer race operatively connected to the crankshaft, a plurality of ratchet pawls pivotally connected to the inner race and urged by springs against the inner race. The one-way clutch is designed such that, when the speed of rotation of the inner race while being rotated by the self-starting motor goes up to a predetermined value, the ratchet pawls are caused to swing in a radial outward direction under the action of centrifugal force against the bias of the springs and become engaged by the outer race to thereby engage the one-way clutch.

17 Claims, 20 Drawing Sheets

ENGINE STARTING DEVICE

BACKGROUND OF THE INVENTION

1. Field of the Invention

The present invention relates to an engine starting device including a self-starter mechanism for starting an engine.

2. Description of the Related Art

Some of engines used in agricultural machinery or snowplows include an engine starting device equipped with a two-way or dual starting system having a self-starter mechanism and a recoil starter mechanism.

The self-starter mechanism includes a self-starting motor adapted to be driven by a starter button and is constructed to transmit rotation of the self-starting motor to a crankshaft of the engine for rotating the crankshaft until the engine fires and continues to run on its own power. The self-starter mechanism is easy to handle because the engine can be driven or started by merely depressing the starter button.

Since the agricultural machinery and snowplows are seasonal equipment used in a particular season of the years it occurs likely that the self-starting motor cannot start the engine due to a battery having being discharged during a non-use period of the equipment.

The recoil starter mechanism includes a starting rope adapted to be pulled by the operator to rotate a pulley and is constructed to transmit rotation of the pulley to the crankshaft for starting the engine. The recoil starter mechanism arranged to manually rotate the crankshaft is advantageous in that the engine can be started even when the battery is dead.

One example of the engine starting devices having such two-way starting system is disclosed in Japanese Patent Laid-open Publication No. HEI-2-108854.

The disclosed engine starting device is re-illustrated here in FIG. 19A. As shown, the engine starting device generally denoted by 150 is activated to start an engine 168 by using a self-starter mechanism.

A self-starting motor 151 of the engine starting device 150 is driven to rotate an output shaft 152 whereupon rotation of the output shaft 152 is transmitted through a first gear 153 and a second gear 154 to a first intermediate shaft 155. Subsequently, rotation of the first intermediate shaft 155 is transmitted through a third gear 156 and a fourth gear 157 to a second intermediate shaft 158. Then, rotation of the second intermediate shaft 158 is transmitted through a first one-way clutch 160 and a fifth gear 163 to a sixth gear 164. Rotation of the sixth gear 164 is transmitted via a third one-way clutch 165 to a crankshaft 166 of the engine 168 whereby the crankshaft 166 is rotated until the engine 168 fires and continue to run on its own power. In this instance, a second one-way clutch 170 is in the disengaged or released position so that rotation of the sixth gear 164 is not transmitted to a pulley 171.

As diagrammatically shown in FIG. 19B, the first one-way clutch 160 is of the type generally known in the art and includes an inner race 160*a* mounted to the second intermediate shaft 158, an outer race 160*b* concentric to the inner race 160*a*, a plurality of substantially triangular or wedge-like recesses 160*c* formed in an outer circumferential surface of the inner race 160*a* such that respective wedge-shaped portions of the recesses 160*c* are directed in the same circumferential direction of the inner race 160*a*, a plurality of balls 160*d* each received in one of the wedge-like recesses 160*c*, and a plurality of springs 160*e* each disposed in one of the wedge-like recesses 160*c* and urging the associated ball 160*d* toward the wedge-shaped portion of each recess 160*c*.

When the second intermediate shaft 158 rotates clockwise as indicated by the arrow x shown in FIG. 19B, the inner race 160*a* rotates in unison with the second intermediate shaft 158. Rotation of the inner race 160*a* in the direction of the arrow x wedges balls 160*d* between an inner circumferential surface of the outer race 160*b* and the recessed outer circumferential surface of the inner race 160*a*, whereby the inner race 160*a* and the outer race 160*b* are connected together (that is, the one-way clutch 160 is engaged). Thus, rotation of the second intermediate shaft 158 is transmitted to the outer race 160*b* to thereby rotate the fifth gear 163 in the direction of the arrow x. By thus rotating the fifth gear 163, the crankshaft 166 is rotated to start the engine 168, as described above with reference to FIG. 19A.

When the engine 168 is to be started by using the recoil starter mechanism, the operator while gripping a grip 174 pulls a starting rope 175 as indicated by the arrow shown in FIG. 20A to thereby rotate a pulley 171. Rotation of the pulley 171 is transmitted through the second one-way clutch 170 and the third one-way clutch 165 to the crankshaft 166 whereby the crankshaft 166 is rotated to start the engine 168.

In this instance, the fifth gear 163 is rotated in the direction of the arrow x, and rotation of the fifth gear 163 is transmitted to the first one-way clutch 160.

Rotation of the fifth gear 163 in the direction of the arrow x causes the outer race 160*b* of the one-way clutch 160 to rotate in the same direction x as the fifth gear 163. Sine the second intermediate shaft 158 and the inner race 160*a* are held stationary, rotation of the outer race 160*b* in the direction of the arrow x releases the balls 160*d* from wedging engagement between the inner circumferential surface of the outer race 160*b* and the recessed outer circumferential surface of the inner race 160*a*, as shown in FIG. 20B. Thus, the inner race 160*a* and the outer race 160*b* are disengaged from each other (i.e., the one-way clutch 160 is released). As a result, rotation of the fifth gear 163 is not transmitted to the self-starting motor 151.

However, it may occur that when the engine 168 is about to stop, a piston (not shown) of the engine 168 cannot move past the upper dead center, causing the crankshaft 166 to rotate in the reverse direction, as indicated by the arrow shown in FIG. 21A. Reverse rotation of the crankshaft 166 is transmitted to the first one-way clutch 160 successively through the third one-way clutch 165, sixth gear 164 and fifth gear 163.

As the fifth gear 163 is thus rotated in the direction of the arrow y, the outer race 160*b* of the first one-way clutch 160 rotates in the direction of the arrow y, as shown in FIG. 21B. Rotation of the outer race 160*b* in the direction of the arrow y wedges the balls 160*d* between the inner circumferential surface of the outer race 160*b* and the recessed outer circumferential surface of the inner race 160*a*, whereby the inner race 160*a* and the outer race 160*b* are connected together (i.e., the one-way clutch 160 is engaged). As a result, the inner race 160*a* rotates in unison with the outer race 160*b* in the direction of the arrow y.

This will cause that rotation of the inner race 160*a* and second intermediate shaft 155 is transmitted to the output shaft 152 successively through the fourth gear 157, third gear 156, first intermediate shaft 155, second gear 154 and first gear 153. This means that the self-starting motor 161 is rotated in the reverse direction. To deal with this problem, the self-starting motor 161 requires strengthening or reinforcement of structural components which will induce additional cost and labor.

In the case where the engine is installed in a snowplow, it may occur that the self-starting motor 161 is driven before a lot of snow deposited on a snowplow attachment is removed, resulting in a failure to rotate the crankshaft against a heavy load exerted on the snowplow attachment. In this instance, the self-starting motor 161 is overloaded. To deal with this problem, the self-starting motor components require extensive strengthening.

SUMMARY OF THE INVENTION

It is accordingly an object of the present invention to provide an engine starting device which is capable of preventing a self-starting motor from being rotated in the reverse direction and also from being overloaded.

Another object of the present invention is to provide an engine starting device including a highly durable one-way clutch.

A further object of the present invention is to provide an engine starting device which is capable of suppressing operation noise when a one-way clutch is allowed to free wheel after a self-starting motor is shut off.

According to the present invention, there is provided an engine starting device for rotating a crankshaft of an engine to start the engine. The engine starting device includes a self-starting motor drivable to rotate the crankshaft of the engine, and a one-way clutch disposed between the self-starting motor and the crankshaft of the engine and operable to transmit rotary motion of the self-starting motor to the crankshaft. The one-way clutch is comprised of an inner race operatively connected to an output shaft of the self-starting motor for co-rotation therewith, an outer race concentric to the inner race and operatively connected to the crankshaft, a plurality of ratchet pawls pivotally connected to the inner race for pivotal movement within an annular space defined between the inner race and the outer race, and a plurality of springs acting between the inner race and the ratchet pawls and urging the ratchet pawls against the inner race to thereby keep the ratchet pawls out of contact with the outer race. The one-way clutch is arranged such that when the speed of rotation of the inner race while being rotated by the self-starting motor goes up to a predetermined value, the ratchet pawls are caused to swing in a radial outward direction under the action of centrifugal force against the force of the springs and become engaged by the outer race to thereby engage the one-way clutch.

When the crankshaft is reversed, reverse rotation of the crankshaft is transmitted to the outer race. In this instance, however, since the ratchet pawls are normally urged against the inner race and hence held out of contact with the outer race, transmission of reverse rotation of the crankshaft to the inner race does not take place. The self-starting motor can thus be protected against destructive overload.

In one preferred form, the outer race has a plurality of ratchet teeth formed on an inner circumferential surface of the outer race. The ratchet teeth are lockingly engageable with respective free ends of the ratchet pawls.

In order to facilitate smooth engaging operation of the one-way clutch, it is preferable that the number of the ratchet teeth is at least equal to the number of the ratchet pawls. The number of the ratchet teeth may be an integral multiple of the number of the ratchet pawls.

The ratchet pawls preferably have a pivot shaft rotatably supported at opposite ends thereof to the inner race so as to ensure reliable operation of the ratchet pawls. In one preferred form, one end of the pivot shaft is rotatably received in an axial hole formed in the inner race and the other end of the pivot shaft is rotatably received in a hole formed in a support plate attached to the inner race.

The engine starting device may further include a torque limiter assembled on the output shaft of the self-starting motor for protecting the self-starting motor against overload. The torque limiter is designed to automatically slip at a predetermined torque.

In one preferred form, the torque limiter is comprised of an inner race rotatably mounted on the output shaft of the self-starting motor, a plurality of lock pins partly received in a plurality of axial grooves, respectively, formed in an outer circumferential surface of the inner race, a bias member for urging the lock pins into the axial grooves, and an outer race concentric to the inner race and firmly connected to the output shaft of the self-starting motor. The outer race has a plurality of axial grooves formed in an inner circumferential surface thereof for receiving respectively therein at least a part of the locking pins. The axial grooves of the outer race have a depth large enough to fully accommodate therein the lock pins. It is preferable that the axial grooves of the inner race have a generally V-shaped cross section, and the axial grooves of the outer race have a generally U-shaped cross section.

The bias member of the torque limiter is a resilient ring wound around the lock pins and resiliently urging the lock pins in a radial inward direction. The resilient ring may be a coiled ring spring. The lock pins preferably have a circumferentially grooved central portion in which the resilient ring is partly received. The outer race may further have a circumferential groove formed in the inner circumferential surface thereof for receiving therein part of the resilient ring.

In one preferred form, the engine starting device further include a motor drive circuit for driving the self-starting motor. The motor drive circuit includes a start switch adapted to be turned on and off to electrically connect and disconnect the self-starting motor with a source of electric power for energizing and de-energizing the self-starting motor, and a short circuit formed across terminals of the self-starting motor when the start switch is turned off.

By thus short-circuiting the terminals of the self-starting motor when the start-switch is turned off to shut off the self-starting motor, a dynamic braking system is created in which the retarding force is supplied by the self-starting motor itself that originally was the driving motor. Thus, the self-starting motor can be stopped suddenly by the effect of a braking action resulting from a counter electromotive force. Since the self-starting motor comes to a sudden stop, the centrifugal force acting on the ratchet pawls is killed suddenly. Thus, the ratchet pawls are allowed to rapidly return to their original released position under the force of the springs. With this rapid returning of the ratchet pawls, the one-way clutch can be disengaged or released without involving interference or collision between the ratchet teeth and the ratchet pawls which would otherwise result in the generation of striking noise and vibrations. Thus, the engine starting device including the motor drive circuit is able to operate silently.

The source of electric power may be an a.c. power source. The self-starting motor may be a d.c. motor in which instance the motor control circuit further includes a power circuit for converting a.c. voltage to d.c. voltage. Preferably, the engine starting device is incorporated in an engine installed in an engine-driven snowplow.

The above and other objects, features and advantages of the present invention will becomes apparent to these versed in the art upon making reference to the following detailed description and accompanying sheets of drawings in which a certain preferred structural embodiment incorporating the principle of the present invention are shown by way of illustrative example.

DETAILED DESCRIPTION OF THE PREFERRED EMBODIMENT

Figure 1:
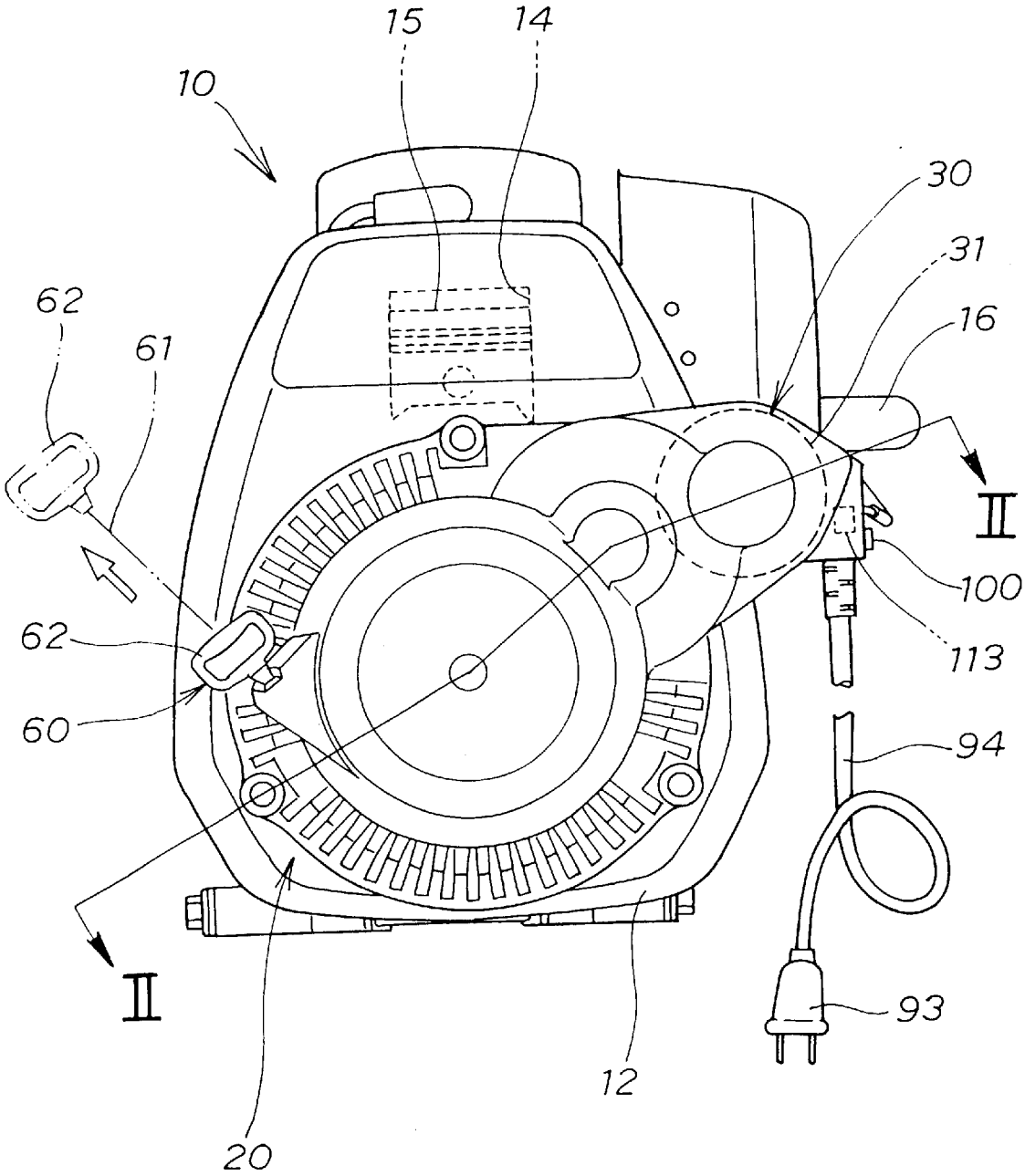
FIG. 1 is a front elevational view of an engine equipped with an engine starting device according to an embodiment of the present invention.

Referring now to the drawings and FIG. 1, in particular, there is shown an engine in which an engine starting device according to the present invention is incorporated.

The engine 10 includes a crankcase 12, a cylinder bore 14 formed in a cylinder block (not designated) disposed on an upper surface of the crankcase 12, a piston 15 disposed for reciprocating movement within the cylinder bore 14, an exhaust pipe 16 provided on one side (right-hand side in FIG. 1) of the piston 15, and an engine starting device 20 mounted to the crankcase 12.

The engine starting device 20 is of the two-way type including a self-starter mechanism 30 and a recoil starter mechanism 60.

Figure 2:
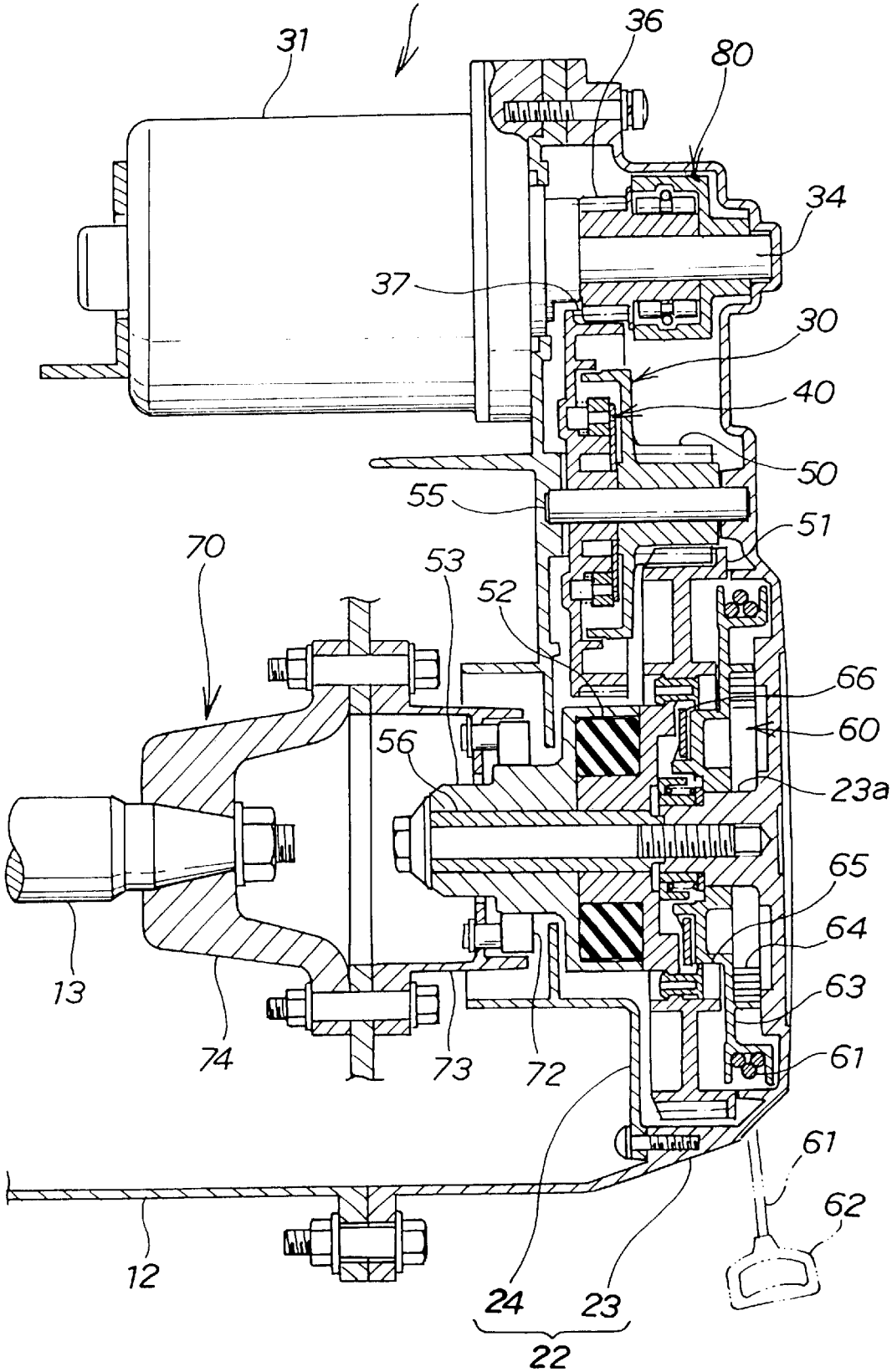
FIG. 2 is an enlarged cross-sectional view taken along line II—II of FIG. 1.

As shown in FIG. 2, the engine starting device 20 includes a casing 22 within which the self-starter mechanism 30 and the recoil starter mechanism 60 are housed, and a torque limiter (overload clutch) 80 built in the self-starter mechanism 30. The casing 22 is composed of a generally cup-shaped outer casing member 23 attached by screw fasteners (one being shown in FIG. 2) to the crankcase 12 and projecting outward from the crankcase 12, and a generally flat plate-like inner casing member 24 attached by screw fasteners (one being shown in FIG. 2) to the outer casing member 23 form an interior side of the outer casing member 23.

The self-starter mechanism 30 operates to automatically start the engine 10 when an engine start button (not shown) is depressed. The self-starter mechanism 30 includes a starter motor (self-starting motor) 31 mounted to the casing 22, a first gear 36 connected to an output shaft 34 of the self-starting motor 31 via the torque limiter 80, a second gear 37 being in mesh with the first gear 36, a third gear 50 connected to the second gear 37 via a first one-way clutch 40, a fourth gear 51 being in mesh with the third gear 50, and an output shaft 53 connected to the fourth gear 51 via a rubber damper 52.

The second and third gears 37 and 50 are rotatably mounted on a first intermediate shaft 55. Similarly, the fourth gear 51 and the output shaft 53 are rotatably mounted on a second intermediate shaft 56. The rubber damper 52 acts to dampen pulsation or vibrations which may occur between the forth gear 51 and the output shaft 53.

The recoil starter mechanism 60 operates to manually start the engine 10 when the operator pulls a starting wire or rope 61 while gripping a grip ring 62. The recoil starter mechanism 60 includes a pulley 63 around which the starting rope 61 is wound, a return spring 64 urging the pulley 63 to turn in a direction to take up the starting rope 61 therearound when the a pull on the grip ring 62 is released, and a second one-way clutch 65 interconnecting the pulley 63 and the fourth gear 51.

The pulley 63 is rotatably mounted on a support shaft 23*a* formed integrally with an inside surface of the outer casing member 23. The second one-way clutch 65 is able to transmit rotation of the pulley 63 to the fourth gear 51 while preventing transmission of rotation of the fourth gear 51 to the pulley 63. In FIG. 2, reference character 66 denotes a ratchet guide for preventing the pulley 63 from rotating in the reverse direction when the engine 10 is about to stop.

The output shaft 53 is connected to a crankshaft 13 of the engine 10 via a joint mechanism 70. The joint mechanism 70 includes a coupling comprised of a first coupling member 73 connected to the output shaft 53 via a third one-way clutch 72, and a second coupling member 74 connected to the crankshaft 13. The first and second coupling members 73 and 74 are connected together by screw fasteners. The third one-way clutch 72 is arranged to permit transmission of a rotary motion of the output shaft 53 to the crankshaft 13 while preventing transmission of a rotary motion of the crankshaft to the output shaft 53.

When the engine 10 is to be started by the self-starter mechanism 30, the self-starting motor 31 is energized to rotate the output shaft 34. Rotation of the output shaft 34 of the starting motor 1 is then transmitted to the crankshaft 13 successively through the torque limiter 80, the first gear 36, the second gear 37, the first one-way clutch 40, the third gear 50, the forth gear 51, the rubber damper 52, the output shaft 53, the third one-way clutch, the first coupling member 73 and second coupling member 74. The crankshaft 13 is thus rotated until the engine 10 fires and continues to run on it own power.

On the other hand, when the engine 10 is to be started by the recoil starter mechanism. 60, the grip ring 62 is pulled by the operator to unwound the starting rope 61, thereby rotating the pulley 63. Rotation of the pulley 63 is transmitted to the crankshaft 13 successively through the second one-way clutch 65, the fourth gear 51, the rubber damper 52, the output shaft 53, the third one-way clutch 72, the first coupling member 73 and the second coupling member 74. The crankshaft 13 is thus rotated until the engine 10 fires and continues to run on its own power.

Figure 3:
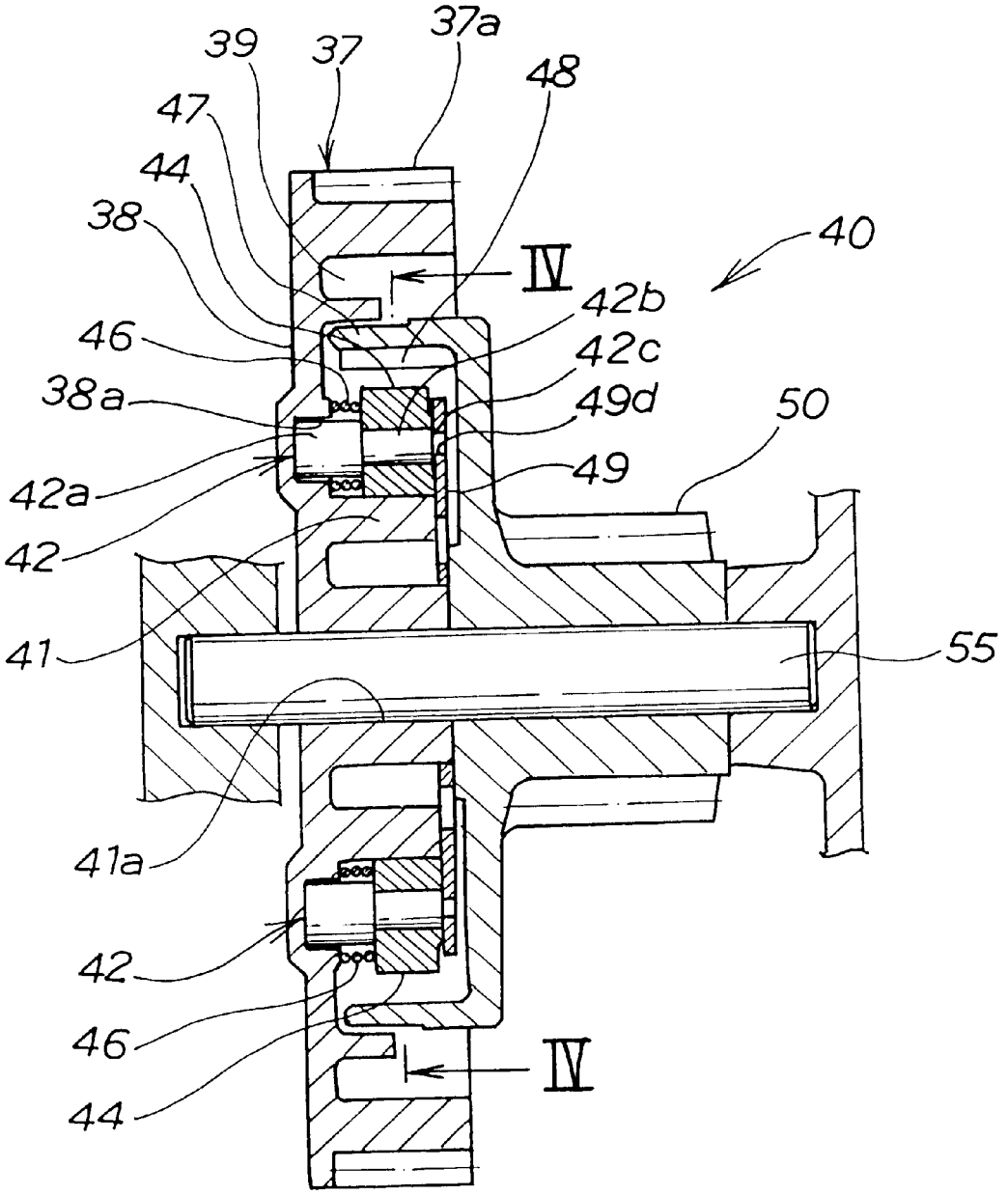
FIG. 3 is an enlarged view showing a portion of the engine starting device shown in FIG. 2, including a one-way clutch acting between a self-starting motor of the engine starting device and a crankshaft of the engine.

As shown in FIG. 3, the second gear 37 is recessed at one side thereof (right-hand side in FIG. 3) and includes a central hub 41 formed with an axial hole 41*a* through which the first intermediate shaft 55 extends, an externally toothed ring-like portion 37*a* concentric with the axial hole 41*a* and having an inside diameter larger than a maximus outside diameter of the hub 41, and a sidewall 38 extending radially between the externally toothed ring-like portion 37*a* and the central hub 41. The second gear 37 which is recessed at one side thereof has a substantially annular space 38 defined jointly between the externally toothed ring-like portion 37*a*, the sidewall 38 and the central hub 41.

The third gear 50 has a ring portion 47 formed integrally with one end thereof (left-hand end in FIG. 3). The ring portion 47 of the third gear 50 is received in the annular space 39 formed in the second gear 37.

The central hub 41 forms a circular inner race of the first one-way clutch 40, and the ring portion 47 forms a circular outer race of the first one-way clutch 40. The inner race (hub) 41 and the outer race (ring portion) 47 are concentric with each other. The inner race 41 formed as an integral part of the second gear 37 is connected to the output shaft 34 of the starting motor 31 (FIG. 2) via meshing engagement between the second gear 37 and the first gear 36. The outer race 47 formed as an integral part of the third gear 50 is connected to the crankshaft 13 (FIG. 2) via a power transmitting system including the third gear 50, the forth gear 51, the rubber damper 52, the output shaft 53, the third one-way clutch 72, and the coupling 70.

Figure 4:
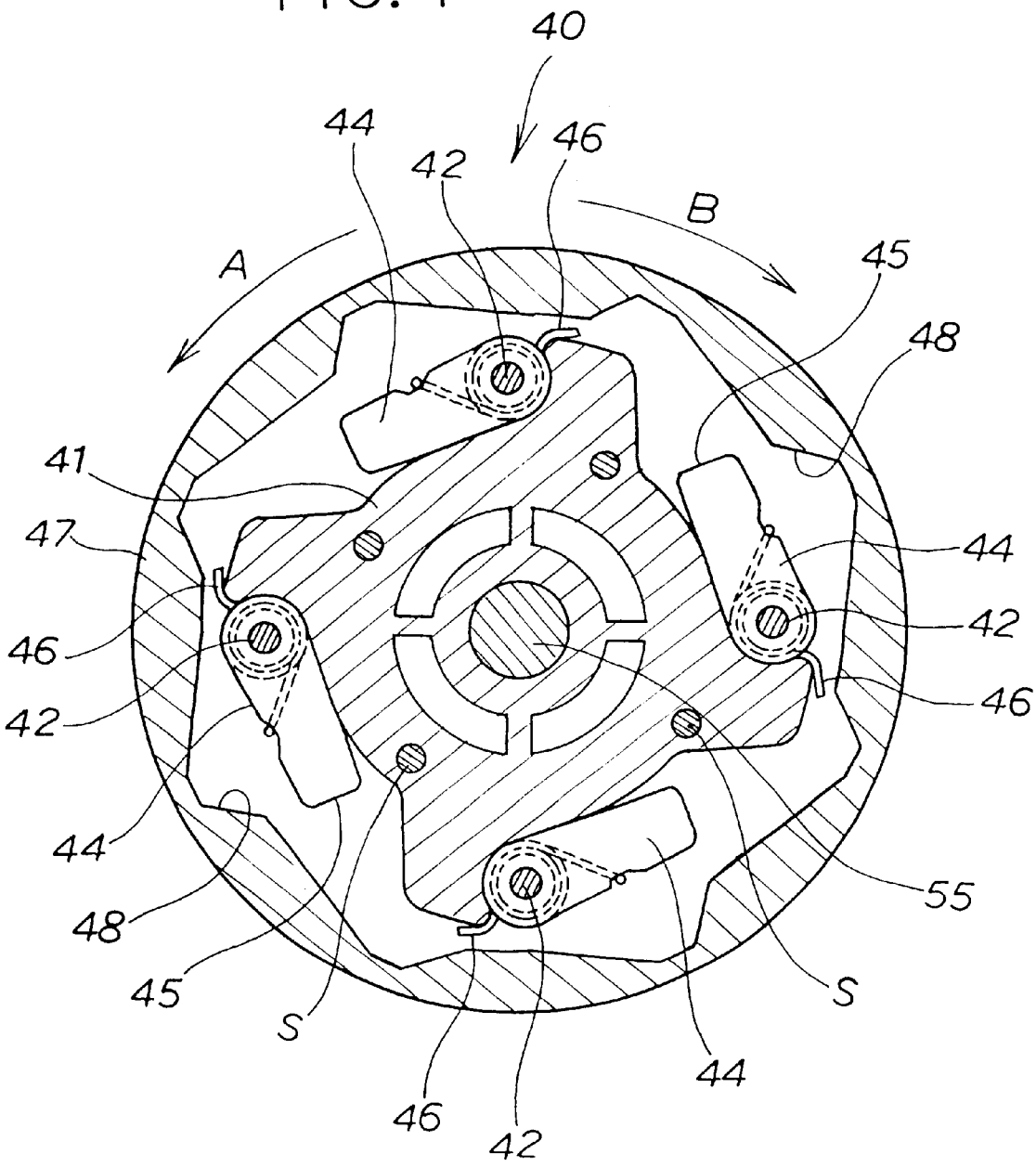
FIG. 4 is a cross-sectional view taken along line IV—IV of FIG. 3.

As shown in FIG. 4, the first one-way clutch 40 also includes a plurality of ratchet pawls 44 pivotally connected to the inner race 41 by means of pivot shaft or pins 42, a plurality of ratchet teeth 48 formed on an inner circumferential surface of the outer race 47, and a plurality of torsion coil springs 46 each acting between the inner race 41 and a corresponding one of the ratchet pawls 44 and urging the ratchet pawl 44 against an outer circumferential surface of the inner race 41 to keep the ratchet pawl 44 out of contact with the outer race 47.

Referring back to FIG. 3, the pivot pins 42 each have a large-diameter base portion 42*a* fitted in a recessed portion 38*a* formed in an inside surface of the sidewall 38 of the second gear 37, a small-diameter central portion 42*b* rotatably supporting thereon each ratchet pawl 44, and a much-smaller-diameter tip portion 42*c* fitted in a hole 49*d* formed in a support plate 49 attached to the inner race 41. With this arrangement, each pivot pin 42 is supported at opposite ends thereof.

The recessed portion 38*a* is formed in the sidewall 38 at a position close to the inner race 41, and each ratchet pawl 44 is supported by one pivot pin 42 having one end (base portion 43*a*) fitted in the recessed portion 38*a*. Since the sidewall 38 is integral with the inner race 41, it can be said that the ratchet pawls 44 are connected to the inner race 41.

As shown in FIG. 4, the ratchet pawls 44 have an elongated rectangular body pivoted at one end to the respective pivot pins 42 and are arranged at equal angular intervals about an axis of the inner race 41. The ratchet teeth 48 formed on the inner circumferential surface of the outer race 47 are profiled such that when the inner race 41 turns in the direction of the arrow A at speeds above a predetermined value, the ratchet pawls 44 are in meshing engagement with a corresponding number of ratchet teeth 48, thereby enabling the outer race 37 to rotate in unison with the inner race 41; and when the inner race 41 turns in the direction of the arrow B at speeds above the predetermined value, the ratchet pawls 44 are allowed to slip on the ratchet teeth 48, thereby, allowing the outer race 37 remains stationary irrespective of rotation of the inner race 41.

The number of the ratchet teeth 48 may be equal to the number of the ratchet pawls 44 or an integral multiple of the number of the ratchet pawls 44. In the illustrated embodiment, eight ratchet teeth 48 are used in combination with four ratchet pawls 44. By thus using a larger number of the ratchet teeth 48 than the ratchet pawls 44, it becomes possible to shorten the distance of angular movement of the inner race 41 which is required to make up an interlocking engagement between the ratchet pawls 44 and the ratchet teeth 48. With this shortening of the angular distance, operation of the one-way clutch 40 in the engaging direction is carried out smoothly.

In the first one-way clutch 40 of the foregoing construction, the ratchet pawls 44 are normally held in a recumbent released position shown in FIG. 4 in which the rachet pawls 44 are urged against the outer circumferential surface of the inner race 41 by the force of the torsion coil springs 46 and thus separated from the ratchet teeth 48. Accordingly, even if the outer race 47 turns in either direction of the arrows A and B, transmission of a rotary motion of the outer race 37 to the inner race 41 does not take place.

When the inner race 41 is rotating in the direction of the arrow A shown in FIG. 4, the ratchet pawls 44 are subjected to a centrifugal force tending to turn or swing the ratchet pawls 44 in a radial outward about the pivot pins 42 against the force of the torsion coil springs 46. The centrifugal force is proportional to the rotating speed of the inner race 41. The force of the torsion coil springs 46 is determined such that as the rotating speed of the inner race 41 approaches a predetermined value (operating speed), centrifugal force pushes the ratchet pawls outward against the force of the torsion coil springs 46 and when the rotating speed of the inner race 41 reaches the predetermined value (operating speed), respective free ends 45 of the ratchet pawls 44 become engaged or caught by a corresponding number of the ratchet teeth 48. The one-way clutch 40 is thus engaged, and the outer race 47 starts to rotate in unison with the inner race 41 in the direction of the arrow A.

Figure 5:
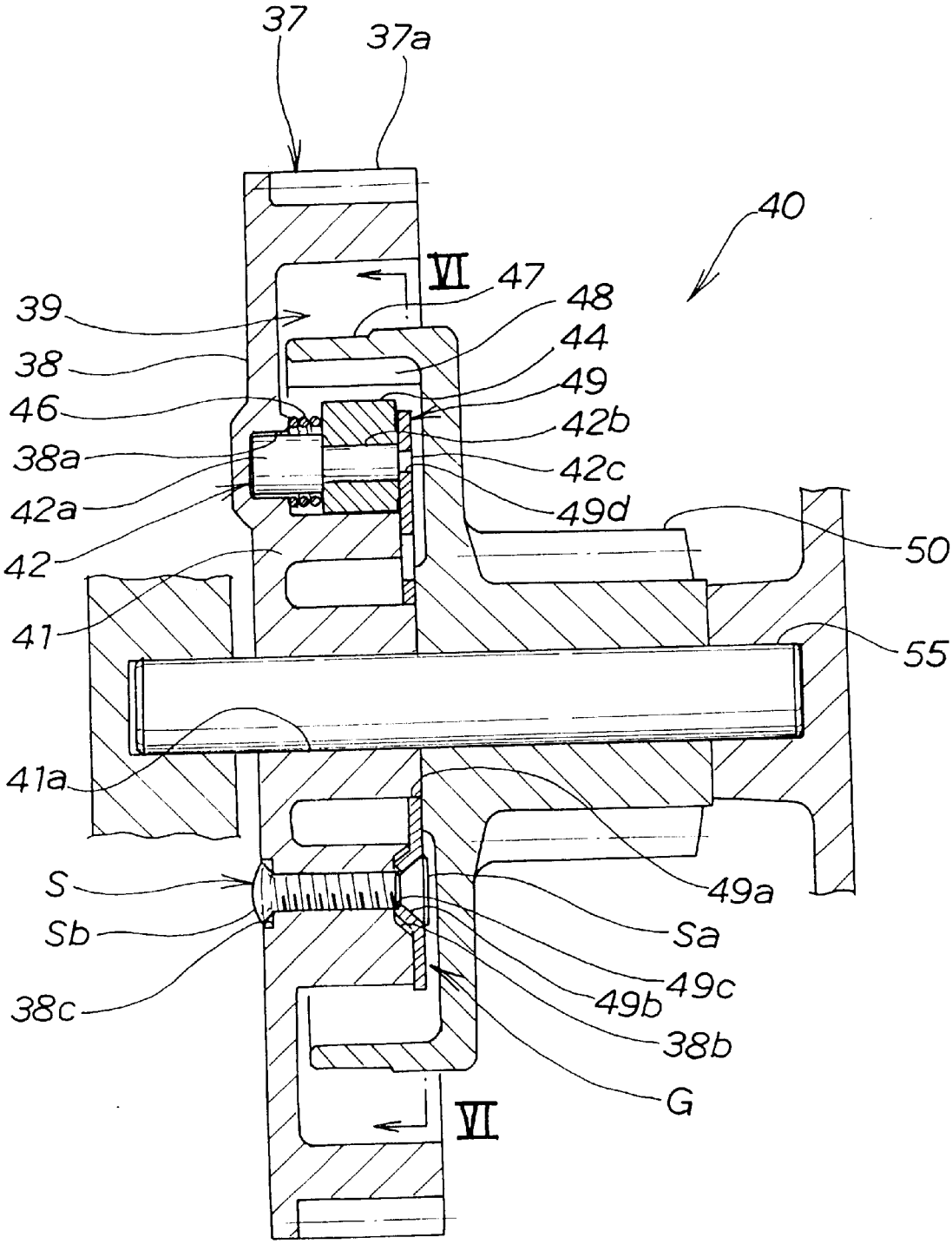
FIG. 5 is a view similar to FIG. 3, but showing a support plate attached to an inner race of the one-way clutch for supporting ratchet pawls.
Figure 6:
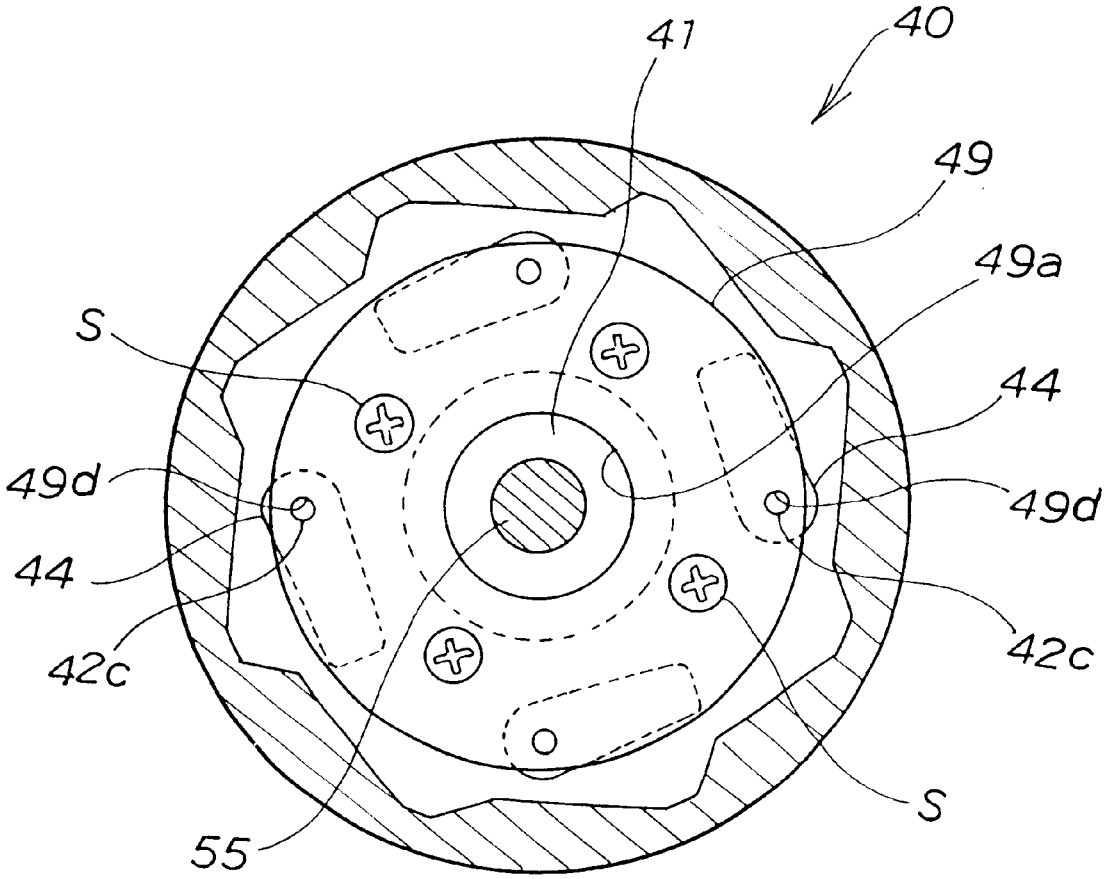
FIG. 6 is a cross-sectional view taken along line VI—VI of FIG. 5.

As shown in FIGS. 5 and 6, the support plate 49 comprises a disk made of a metallic material such as steel and having a central hole 49*a* fitted with a central boss (not designated) of the inner race 41. The support plate 49 may be formed from a synthetic resin. The support plate 49 further has a plurality (four in the illustrated embodiment) of recessed portions 49*b* formed in one surface thereof for receiving therein respective countersunk heads Sa of screws S, a corresponding number of through-holes 49*d* formed in the recessed portions 49 for the passage therethrough of the screws S, and a plurality of holes 49*d* for receiving therein the tip portions 42*c* of the pivot pins 42. The recessed portions 49*b* are circumferentially spaced at equal intervals about the center of the hole 49*a*.

Projections (not designated) formed on the other surface of the support plate 49 as a result of formation of the recessed portions 49*b* are received in recessed portions 38*b* formed in one surface of the inner race 41. The screws S are inserted into the through-holes 49*c* of the support plate 49 and subsequently threaded into the inner race 41. A tip end of each screw S projects from the other surface of the inner race 41 and is riveted into an enlarged foot Sb which is received in a counterbore 38*b* formed in the other surface of the inner race 41.

The countersunk heads Sa of the screws S which are received in the recessed portions 49*d* of the support plate 49 have outside surfaces lying substantially flush with the surface of the support plate 49, so that the support plate 49 can be attached to the inner race 41 notwithstanding a small gap G available between the inner race 41 and the outer race 47 for attachment of the support plate 49 using the screws S. In addition, since the respective tip ends Sb of the screws S are riveted to prevent loosening of the screws S, the pivot pins 42 supported at one end by the support plate 49 can maintain their initial position over a prolonged period of use which will insure operation of the one-way clutch 40 with improved reliability.

Figure 7:
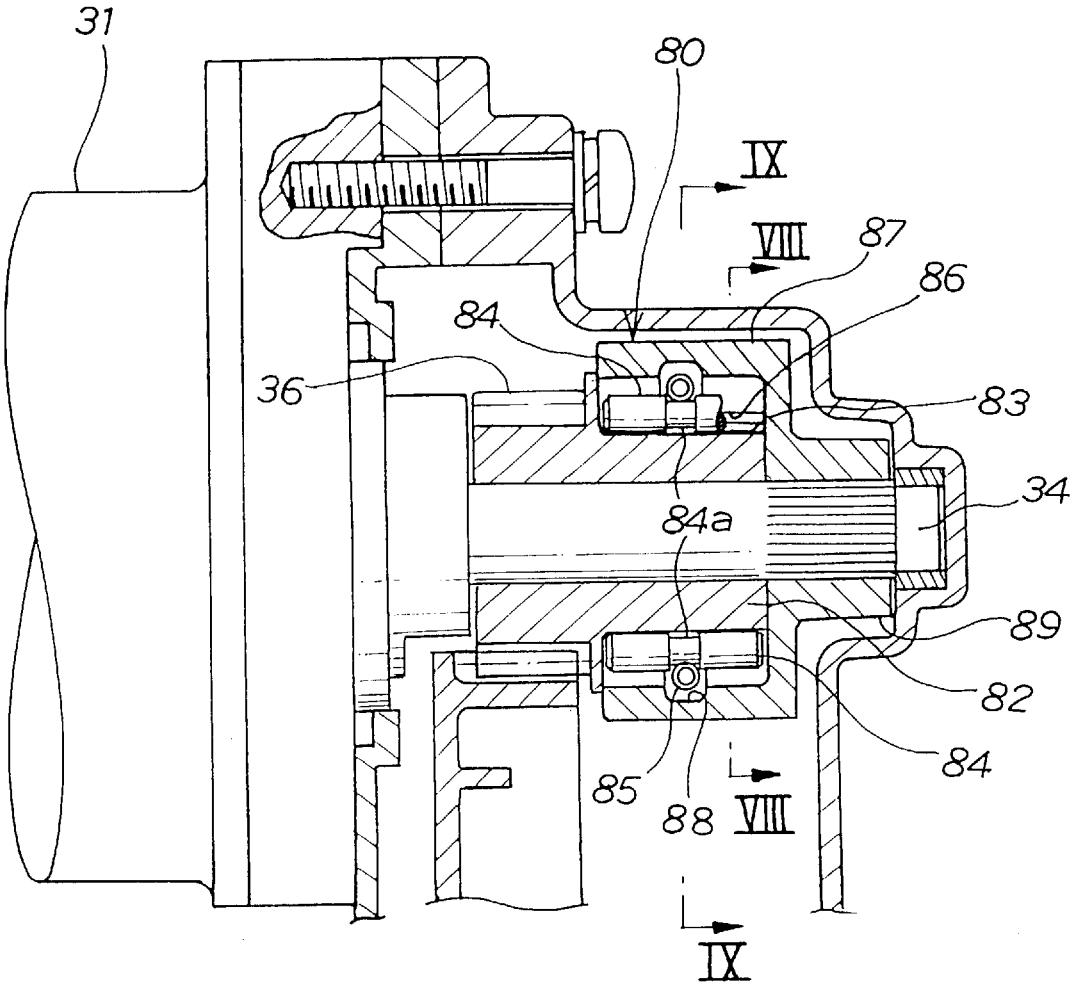
FIG. 7 is an enlarged view showing a portion of the engine starting device shown in FIG. 2, including a torque limiter assembled on an output shaft of the self-starting motor.

As shown in FIG. 7, the torque limiter 80 is assembled on the output shaft 34 of the self-starting motor 31 for protecting the motor 31 against overload.

The torque limiter 80 generally comprises an inner race 82 formed integrally with the first gear 36 and rotatably mounted on the output shaft 34 of the self-starting motor 31, a plurality of lock pins 84 partly received in a plurality of axial grooves 83, respectively, formed in an outer circumferential surface 82*a* (FIG. 8) of the inner race 82 at equal angular intervals, a resilient ring 85 wound around respective circumferentially grooved central portions 84*a* of the lock pins 84 so as to urge the lock pins 84 into the corresponding axial grooves 83, and an outer race 87 concentric to the inner race 82 and having a plurality of axial grooves 86 formed in an inner circumferential surface 87*a* (FIG. 8) thereof for receiving therein at least a part of the locking pins 83. The outer race 87 has an integral boss 89 firmly connected to the output shaft 34 of the starting motor 31.

The resilient ring 85 is comprised of a ring of coiled spring. The coiled spring ring 85 has a plurality of circumferentially spaced portions received in the circumferentially grooved central portions 84*a* of the lock pins 84, so that the coiled spring ring 85 is stably held in position against displacement in the axial direction of the lock pins 84.

Figure 8:
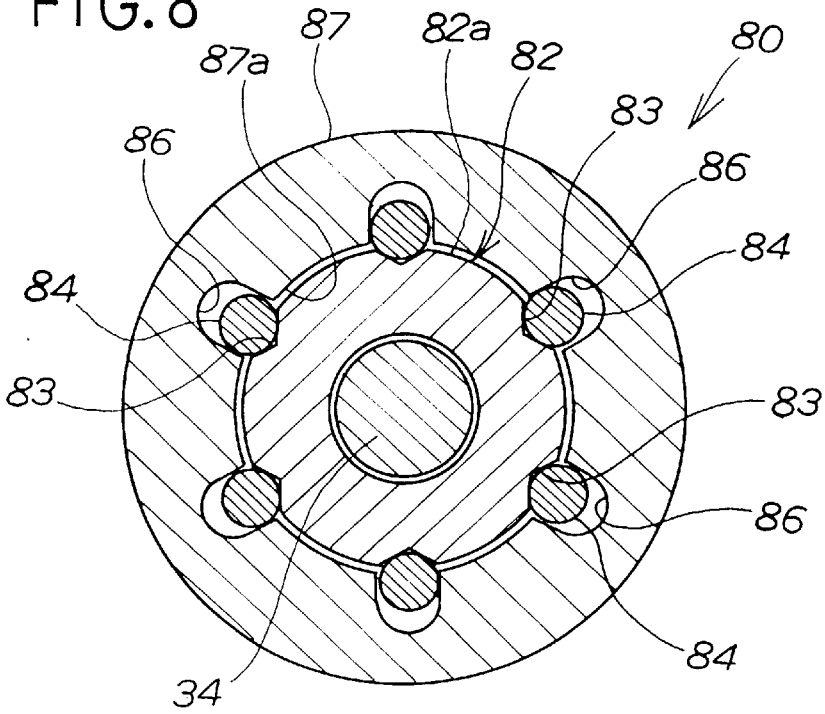
FIG. 8 is a cross-sectional view taken along line VIII—VIII of FIG. 7.

As shown in FIG. 8, the axial grooves 83 of the inner race 82 and the axial grooves 86 of the outer race 87 are faced with each other. The axial grooves 83 of the inner race 82 have a triangular or V-shaped cross section, and the axial grooves 86 of the outer race 87 have a generally U-shaped cross section. The V-shaped axial grooves 83 have a depth much smaller than the diameter of the lock pins 84. The U-shaped axial grooves 86 have a depth greater than the diameter of the lock pins 84 so that the lock pins 84 can be completely received in the U-shaped axial grooves 86 of the outer race 87, as will be described later. The outer race 87 has a circumferential groove 88 (FIGS. 7 and 9) formed in the inner circumferential surface 87*a* thereof for receiving part of the coiled spring ring 85.

Figure 10:
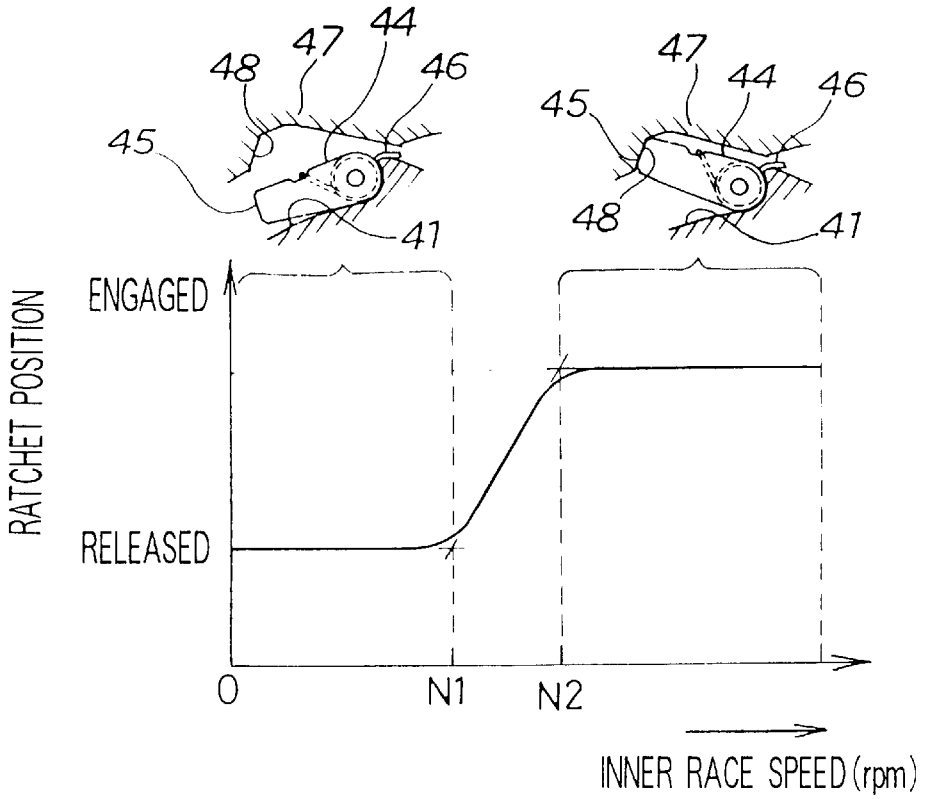
FIG. 10 is a graph showing the relationship between the ratchet position of the one-way clutch and the rotating speed (rpm) of an inner race of the one-way clutch.

Referring now to FIG. 10, there is shown the relationship between the biasing force of the torsion coil springs 46 and the centrifugal force acting on the ratchet pawls 44. In FIG. 10, the vertical axis represents the position of the ratchet pawls 44, and the horizontal axis represents the rotating speed (rpm) of the inner race 41. The centrifugal force acting on the ratchet pawls 44 increases with an increase in the rotating speed of the inner race 41.

When the rotating speed of the inner race 41 is below a first predetermined value (swing start speed) N1, the ratchet pawls 44 are held stationary at the recumbent released position lying flat on the outer circumferential surface of the inner race 41 by the biasing force of the torsion coil springs 46.

When the rotating speed of the inner race 41 goes up to the first predetermined value (swing start speed) N1, the ratchet pawls 44 start to swing in a radial outward direction by the action of centrifugal force against the force of the torsion coil springs 46. As the rotating speed of the inner race 41 further increases, respective free ends 45 of the ratchet pawls 44 gradually approach the outer race 47 under the action of centrifugal force.

Then the rotating speed of the inner race 41 reaches a second predetermined value N2 (operating speed), whereupon the respective free ends 45 of the ratchet pawls 44 become engaged or caught by the ratchet teeth 48 of the outer race 47. Thus, the one-way clutch 40 is engaged, and the outer race 47 starts to rotate in unison with the inner race 44.

Figure 11:
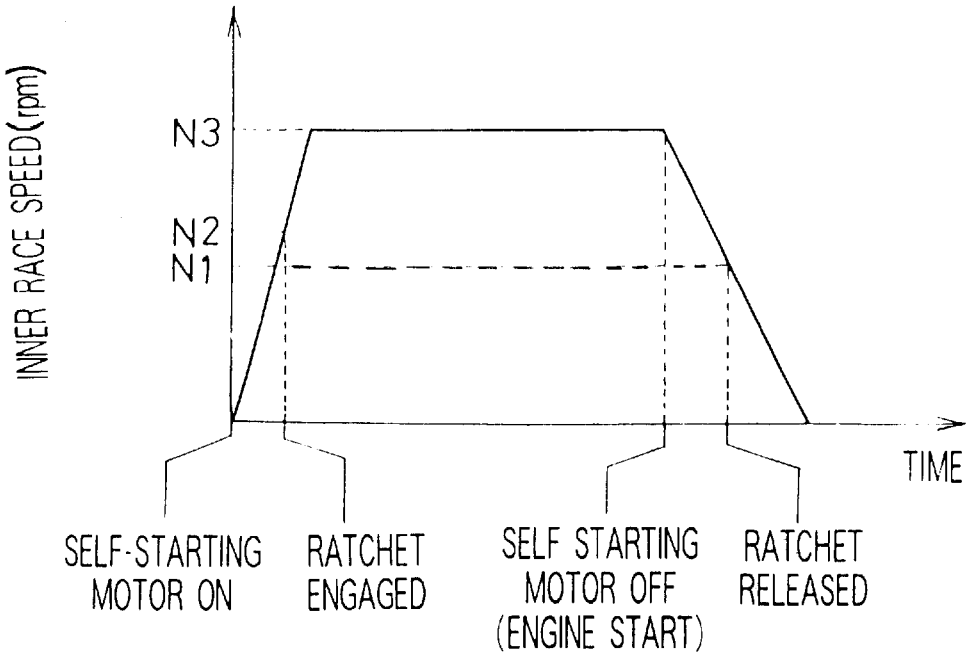
FIG. 11 is a graph showing the relationship between the inner race speed and the ratchet position of the one-way clutch which is established during a single cycle of operation of the engine starting device using the self-starting motor.

Reference is next made to a graph shown in FIG. 11 which illustrates the relationship between the operation of the one-way clutch 40 and the rotating speed of the inner race 41. In FIG. 11, the vertical axis represents rotating speed of the inner race 41, and the horizontal axis represents the time period from the start to the end of one cycle of operation of the self-starting motor 31.

The shelf-starting motor 31 is energized, and the rotating speed of the inner race 41 increases gradually. When the rotating speed of the inner race 41 reaches the second predetermined value (operating speed) N2, the ratchet pawls 44 are engaged or caught by the ratchet teeth 48 of the outer race 47. The one-way clutch 40 is thus engaged, whereupon the crankshaft 13 (FIG. 2) of the engine is rotated. As the rotating speed of the self-starting motor 31 further increases, the rotating speed of the inner race 41 reaches a maximus value N3. Since the one-way clutch 40 is in the engaged position, the rotating speed of the crankshaft 13 also increases for causing the engine 10 to fire and continue to run on its own power.

When the engine 10 starts to run on its own power, the self-starting motor 31 is de-energized. The rotating speed of the inner race 41 gradually slows down and when it falls below the first predetermined value (swing start speed) N1, the ratchet pawls 44 return to the released position by the force of the torsion coil springs 46 (see FIG. 10). The one-way clutch 40 is thus disengaged. The outer race 47 and inner race 41 of the one-way clutch 40 are now separated from one another, transfer of a rotary motion of the crankshaft 13 to the self-starting motor 31 does not take place after the start of the engine 10.

FIGS. 12A through 12D illustrate the operation of the one-way clutch 40 together with the distribution of load applied to the pivot pins 42 achieved when the engine 10 (FIG. 1) is started using the self-starter mechanism 30.

When the self-starting motor 31 shown in FIG. 2 is driven to rotate the output shaft 34, a rotary motion of the output shaft 34 is transmitted to the first one-way clutch 40 through the torque limiter 80, the first gear 36 and the second gear 37.

Figure 12A:
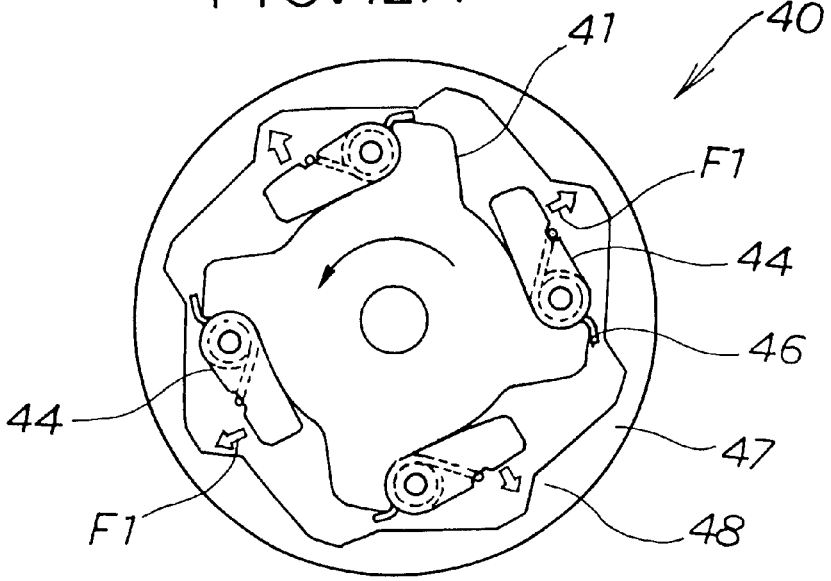
FIGS. 12A through 12D are diagrammatical views illustrative of the operation of the one-way clutch together with the distribution of load applied to a power circuit on which a ratchet pawl is pivotally mounted.
Figure 12B:
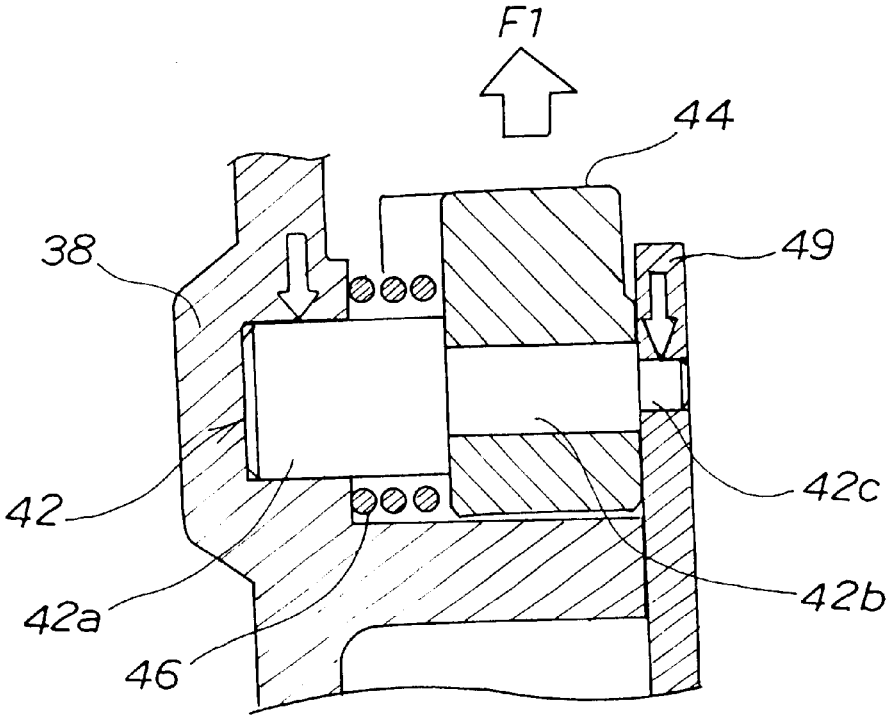

The rotary motion thus transmitted to the first one-way clutch 40 rotates the inner race 41 of the one-way clutch 40 in the direction of the arrow shown in FIG. 12A. In this instance, the ratchet pawls 44 are subjected to a centrifugal force F1 which is proportional to the rotating speed of the inner race 41. The large-diameter base portion 42*a* and the much-smaller-diameter tip portion 42*c* of each pivot pin 42 are subjected to reaction forces, respectively, as they are supported by the sidewall 38 of the second gear 37 and the support plate 49.

When the rotating speed of the inner race 41 reaches the first predetermined value (swing start speed) N1, the ratchet pawls 44 start to swing in a radial outward direction by the action of centrifugal force against the force of the torsion coil springs 46. In this instance, since the centrifugal force acting on each ratchet pawl 44 is born by both longitudinal ends 42*a*, 42*c* of the pivot pin 42, the pivot pin 42 is substantially free from tilting and highly resistant to deformation or bending. The ratchet pawl 43 carried on such pivot pin 42 is, therefore, able to swing smoothly and reliably.

Figure 12C:
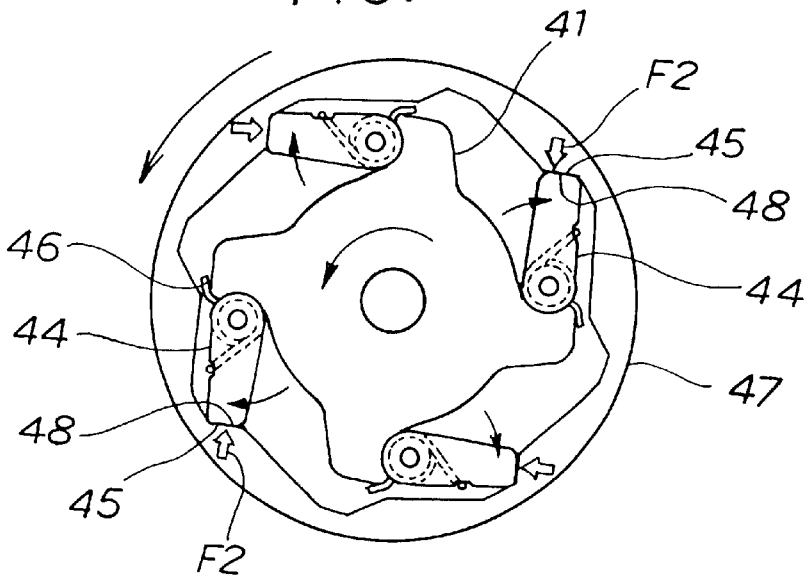
Figure 12D:
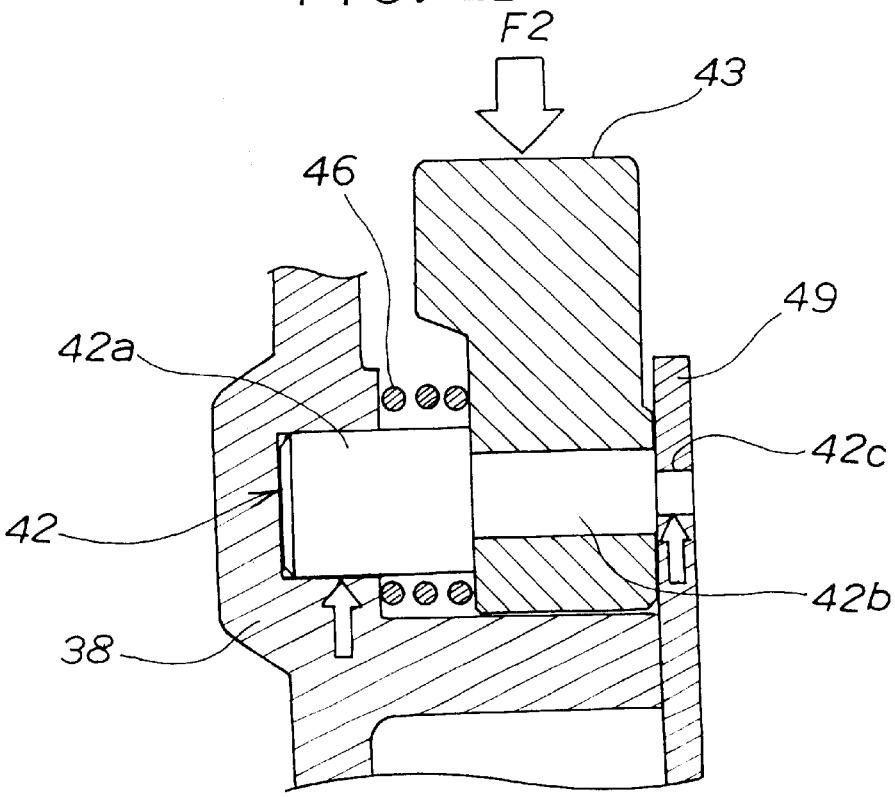

As the rotating speed of the inner race 41 further increases, the respective free ends 45 of the ratchet pawls 44 gradually approach the outer race 47 under the action of centrifugal force. When the rotating speed of the inner race 41 reaches the second predetermined value (operating speed) N2, the free ends 47 of the rachet pawls 44 become caught by the ratchet teeth 48 of the outer race 47, as shown in FIG. 12C. Thus, the rotation of the inner race 41 is transmitted via the ratchet pawls 44 to the outer race 47, causing the outer race 47 to rotate in unison with the inner race as indicated by the arrow in FIG. 12C. In this instance, each of the ratchet pawls 44 is subjected to a reaction force F2 exerted from the ratchet teeth 48 of the outer race 47, and both longitudinal ends (base portion 42*a* and tip portion 42*c*) of the pivot pin 42 are also subjected to a counter force, as shown in FIG. 12D. The pivot pin 42 supported at opposite ends thereof is highly resistant to deformation and substantially free from tilting, so that the ratchet pawl 44 can always operate smoothly and reliably. The one-way clutch 40 having such ratchet pawls 44 is durable over a prolonged period of use.

Rotation of the outer race 47 is transmitted to the crankshaft 13 successively through the third gear 50, forth gear 51, rubber damper 52, output shaft 53, third one-way clutch 72, first coupling member 73 and second coupling member 74. As a result, the crankshaft 13 is rotated to start the engine 10.

After the engine fires and continues to run on its own power, the self-starting motor 31 is stopped or de-energized to thereby stop rotation of the inner race 41 of the one-way clutch 40. When the rotating speed of the inner race 41 falls below the operating speed N2, the ratchet pawls 44 return from the raised engaged position (FIG. 12C) to the recumbent released position (FIG. 13) by the force of the torsion coil springs 46. During that time, the free ends 45 of the ratchet pawls 44 are released from interlocking engagement with the ratchet teeth 48 of the outer race 41. Thus, rotation of the crankshaft 13 is in no way transmitted to the self-starting motor 31 once the engine is started.

An engine starting operation achieved by using the recoil starter mechanism 60 will be described with reference to FIGS. 2 and 13.

In FIG. 2, the grip ring 62 is pulled by the operator to unwound the starting rope 61, thereby rotating the pulley 63. Rotation of the pulley 63 is transmitted to the crankshaft 13 successively through the second one-way clutch 65, the fourth gear 51, the rubber damper 52, the output shaft 53, the third one-way clutch, the first coupling member 73 and the second coupling member 74. The crankshaft 13 is thus rotated until the engine 10 fires and continues to run on its own power.

Figure 13:
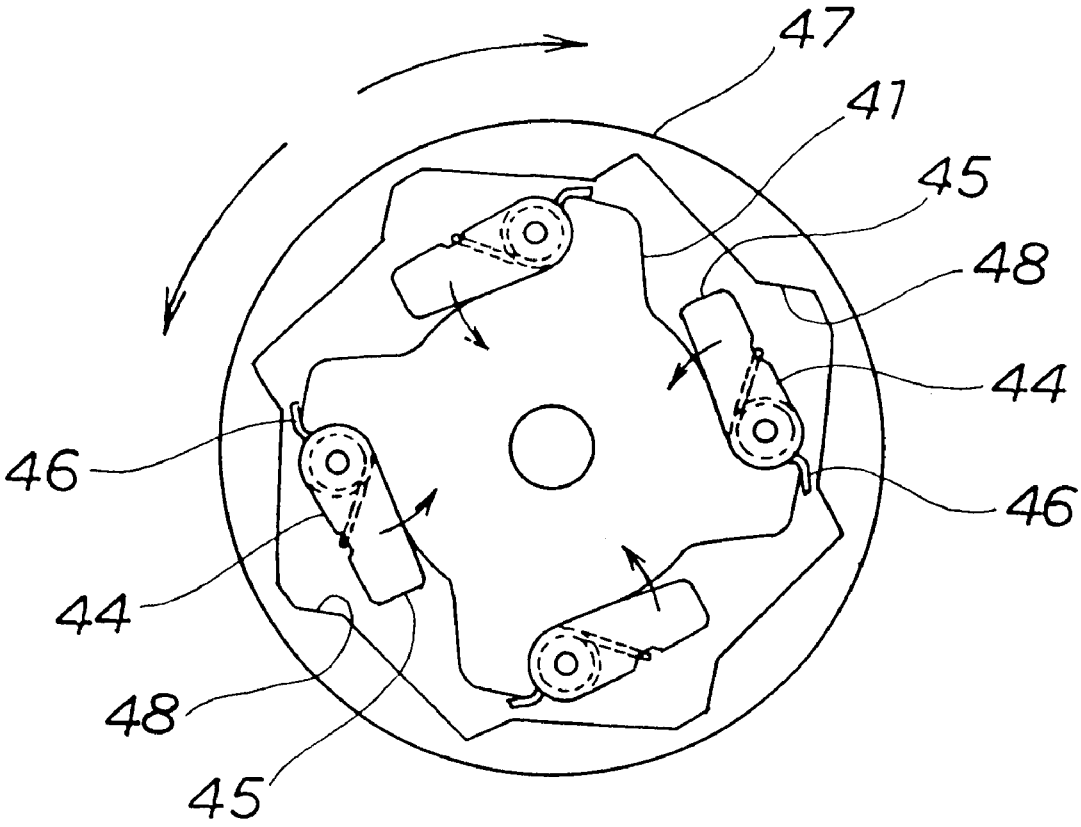
FIG. 13 is a diagrammatical view showing the operation of the one-way clutch when a recoil starter mechanism is actuated.

In this instance, rotation of the forth gear 51 is transmitted via the third gear 50 to the first one-way clutch 40 and thereby rotates the outer race 47 in the counterclockwise direction shown in FIG. 13. However, since the self-starting motor 31 is de-energized due to the use of the recoil starter mechanism 60, the inner race 41 of the first one-way clutch 40 is in the stationary state. Thus, the ratchet pawls 44 biased by the torsion coil springs 4 are held in the recumbent released position lying flat on the outer peripheral surface of the inner race 41. Accordingly, the rotation of the outer race 47 is in no way transmitted to the inner race 41 of the first one-way clutch 40. This means that when the engine 10 is started by using the recoil starter mechanism 60, rotation of any part of the recoil starter mechanism 60 is not transmitted to the self-starting motor 31.

When the crankshaft 13 (FIG. 2) of the engine is reversed after the self-starting motor 31 is de-energized due to the piston 15 (FIG. 1) not having reached to the upper dead center, reverse rotation of the crankshaft 13 is transmitted to the first one-way clutch 40 successively through the second coupling member 74, first coupling member 73, third one-way clutch 72, output shaft 53, rubber damper 52, fourth gear 51 and third gear 50. Thus, the outer race 47 of the one-way clutch 40 is rotated in the clockwise direction as indicated by the arrow shown in FIG. 13.

In this instance, however, since the self-starting motor 31 is de-energized, the inner race 41 of the one-way clutch 40 remains stationary and the ratchet pawls 44 are held by the force of the torsion coil springs 46 in the recumbent released position remote from the ratchet teeth 48 of the outer race 47. The one-way clutch 40 is thus maintained in the disengaged or released state. As a result, rotation of the outer race 47 is not transmitted to the inner race 41 of the first one-way clutch 40. This means that even if the crankshaft 13 of the engine is reversed, rotation of the crankshaft 13 is in no way transmitted to the self-starting motor 31. The self-starting motor 31 is thus prevented from forcible reverse rotation by the crankshaft. This makes it possible to obviate the need for strengthening or reinforcement of structural components of the self-starting motor 31, thereby posing substantial cost-cutting of the engine starting device 20.

Figure 14A:
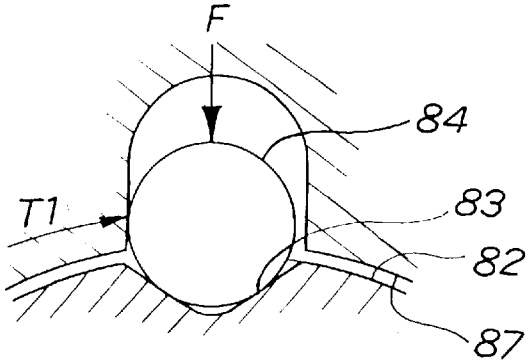
FIGS. 14A through 14C are cross-sectional views illustrative of the operation of the torque limiter.
Figure 14B:
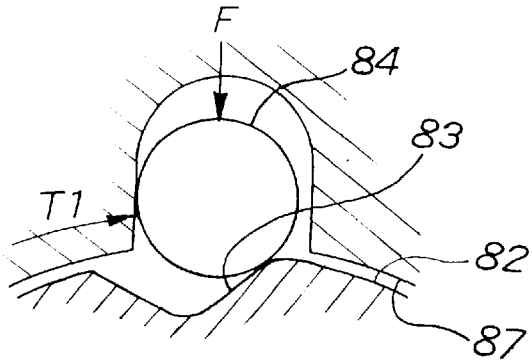
Figure 14C:
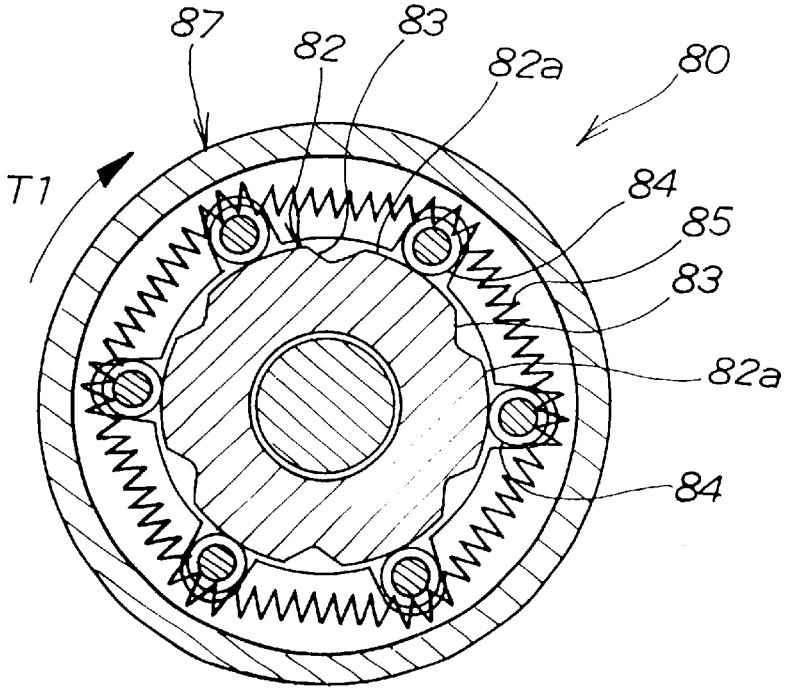

Reference is next made to FIGS. 14A through 14C which show the operation of the torque limiter 80.

Figure 9:
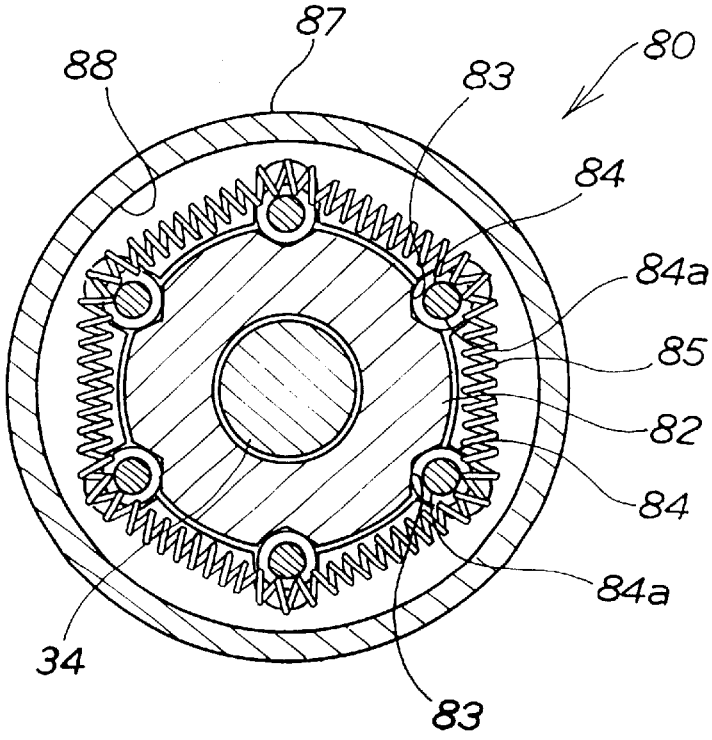
FIG. 9 is a cross-sectional view taken along line IX—IX of FIG. 7.

As shown in FIG. 14A, the lock pins 84 of the torque limiter 80 are normally urged into the axial grooves 83 of the inner race 82 by the force F of the coiled ring spring 85 (FIG. 9). When the self-starting motor 31 (FIG. 7) is driven, a rotational force or torque T1 is applied to the outer race 87 of the torque limiter 80. The torque T1 is transmitted via the lock pins 84 to the inner race 82 whenever the torque T1 is less than a predetermined value. The inner race 82 is thus rotated in unison with the outer race 87. Rotation of the inner race 82 is transmitted via the first gear 36 (FIG. 7) to the second gear 37 and eventually used to start the engine.

When the torque T1 acting on the outer race 87 reaches the predetermined value, the lock pins 84 are forced to move in a radial outward direction against the force F of the coiled ring spring 85, as shown in FIG. 14B. The lock pins 84 slide up along one sidewall or flank of the axial grooves 83 and eventually ride on the outer circumferential surface 82*a* of the inner race 82, as shown in FIG. 14C. Thus, the torque limiter 80 automatically slip at the predetermined torque, thereby separating the output shaft 34 of the self-starting motor 31 from the load (including the crankshaft 13). The torque limiter 80 thus prevents the self-starting motor 31 against destructive overload.

In the case where the engine 10 (FIG. 1) is installed in a snowplow, the torque limiter 80 operates to protect the self-starting motor 31 against overload when the self-starting motor 31 is energized before a large amount of snow deposited on a snowplow attachment is removed. The use of the torque limiter 80 in combination with the self-starting motor 31 dispenses with the need for strengthening or reinforcement of the components of the self-starting motor 31.

Figure 15:
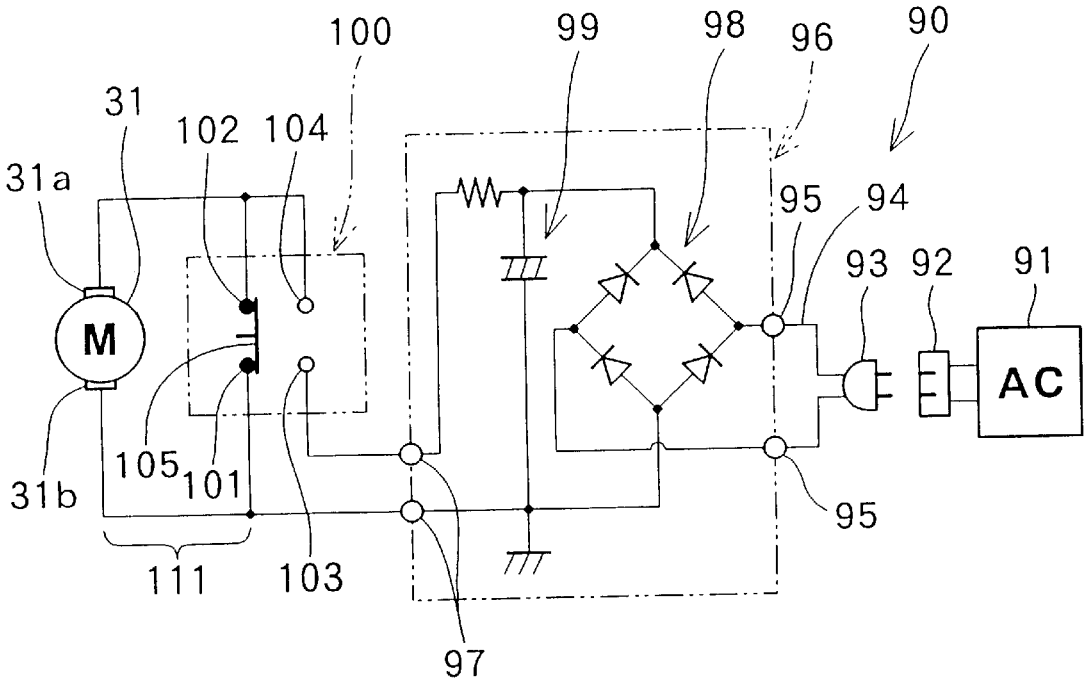
FIG. 15 is a circuit diagram showing a motor drive circuit of the engine starting device according to an embodiment of the present invention.

FIG. 15 shows a circuit diagram of a motor drive circuit 90 used for driving the self-starting motor 31 according to an embodiment of the present invention.

The motor drive circuit 90 includes a start switch 100 by means of which the self-starting motor 31 can be electrically connected to a power source 91. When the start switch 100 is turned on or activated, electric power from the power source 91 is supplied across terminals 31*a* and 31*b* of the self-starting motor 30 to thereby energize the self-starting motor 30. The motor drive circuit 90 also includes a short circuit 111 which, when the start switch 100 is turned off or de-activated, is made or completed to short-circuit the terminals 31*a* and 31*b* of the self-starting motor 31. The power source 91 is an a.c. power source such as a domestic single-phase power line. The self-starting motor 31 is a d.c. motor.

More specifically, the motor drive circuit 90 further includes a cable 94 having one end affixed with a plug connector 93 adapted to be removably connected to a plug receptacle 92 forming an outlet of the a.c. power source 91. The opposite end of the cable 94 is connected to primary terminals 95, 95 of a power circuit 96 which converts a.c. voltage to d.c. voltage. Secondary terminals 97, 97 of the power circuit 96 are connected to the terminals 31*a*, 31*b* via the start switch 100.

The power circuit 96 is a composite circuit including, in combination, a bridge rectifier 98 and a smoothing circuit 99.

The start switch 100 is a push-button switch adapted to be actuated by the operator for starting and stopping the self-starting motor 31. The push-button switch 100 is a so-called "push-to-push" switch (also called "maintained-action" push-button switch arranged such that when the operator actuates the maintained-action switch 100, the switch contacts move to transfer the circuit to the second set of contacts; No change takes place with the contacts when the operator removes its hand from switch 100, even though the actuator (starter button) may return to the original position; and when the operator actuates the switch 100 a second time, the circuit returns to the original position). The start switch 100 has a normally closed contact 101, 102, a normally open contact 103, 104, and a movable contact 105 that is moved directly by the actuator (start button) for switching the normally closed contact 101, 102 and the normally open contact 103, 104.

The secondary terminals 97, 97 of the power circuit 96 are connected to the terminals 31*d*, 31*b* of the self-starting motor 31 via the normally open contact 103, 104. The short circuit 111 is a closed circuit including the self-starting motor 31 and adapted to be closed or completed when the terminals 31*a*, 31*b* of the self-starting motor 31 are connected to the normally closed contact 101, 102 via the movable contact 105.

The motor drive circuit 90 of the foregoing arrangement operates as follows.

When the operator depresses the start button (not shown) to activate the start switch 100 (FIG. 15), the movable contact 105 is brought into contact with the normally open contact 103, 104 whereupon d.c. power from the power circuit 96 is supplied across the terminals 31*a*, 31*b*, thereby energizing the self-starting motor 31. The self-starting motor 31 then rotates the crankshaft of the engine 10 (FIG. 1) so as to carries out an engine starting operation in the manner as described previously.

When the engine 10 (FIG. 1) starts to run on its own power, the non-illustrated start button is depressed again to deactivate the start switch 100. With this depression of the start button, the movable contact 105 disengages from the normally open contact 103, 104 so that supply of d.c. power to the self-starting motor 31 is terminated. The movable contact 105 then returns to its original position at which the movable contact 105 is in contract with the normally closed contract 101, 102. Thus the terminals 31*a* and 31*b* of the self-starting motor 31 are short-circuited whereupon a dynamic braking system is created in which the retarding force is supplied by the same machine (self-starting motor 31) that originally was the driving motor. Thus, the self-starting motor 31 can be stopped suddenly by the effect of a braking action resulting from a counter electromotive force.

Since the self-starting motor 21 comes to a sudden stop, the centrifugal force acting on the ratchet pawls (FIG. 12C) is killed suddenly. Thus, the ratchet pawls 44 are allowed to rapidly return to their original released position of FIG. 12A under the force of the torsion coil springs 46. With this rapid returning of the ratchet pawls 44, the one-way clutch 40 can be disengaged or released without involving interference or collision between the ratchet pawls 44 and the ratchet teeth 48 which would otherwise result in the generation of striking noise and vibrations. Thus, the engine starting device 20 including the motor drive circuit 90 is able to operate silently.

Figure 16:
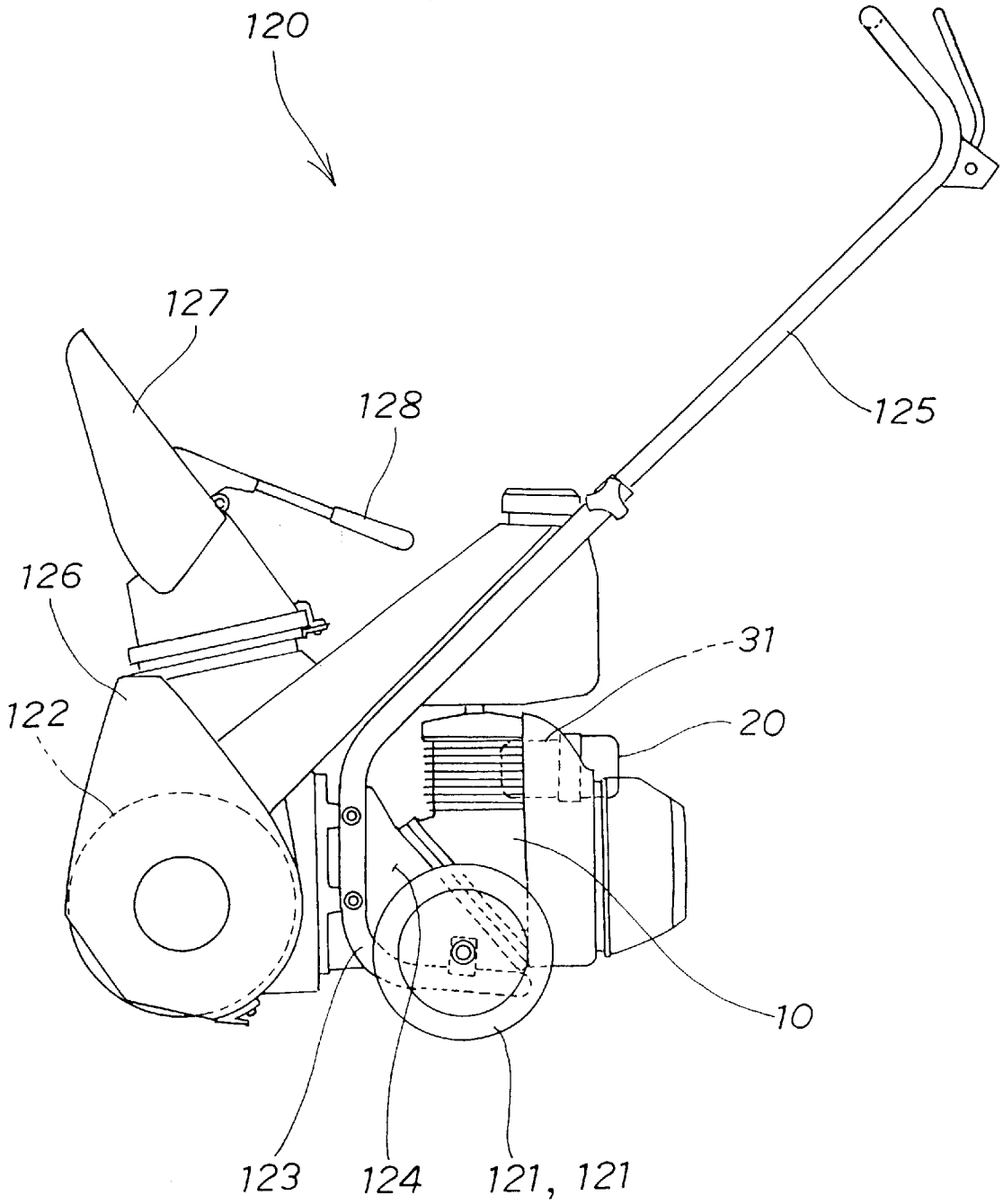
FIG. 16 is a side view of an engine-powered snowplow equipped with an engine starting device according to the present invention.

FIG. 16 shows an engine-powered portable snowplow 120 equipped with the engine starting device 20 according to the present invention.

The snowplow 120 includes right and left wheels 121 (right wheel being shown) rotatably mounted to a lower portion of a frame 123, a rotary snowplow attachment 122 mounted to a front portion of the frame 123, an engine 10 mounted to a rear portion of the frame 123, a power transmitting mechanism 124 disposed between the engine 10 and the snowplow attachment 122, and a handle 125 extending upwardly and rearwardly from a rear end of the frame 123.

The power transmitting mechanism 124 is constructed to transmit power of the engine 10 to the snowplow attachment 122 and the wheels 121. The engine starting device 20 of the present invention is installed on the engine 10 for starting the same. Though not shown, the engine starting device 10 includes a motor drive circuit such as denoted by 90 shown in FIG. 15. The snowplow attachment 122 includes a housing 126, a shooter 127 attached to the housing 126, and a handle 128 for actuating the shooter 127.

Figure 17A:
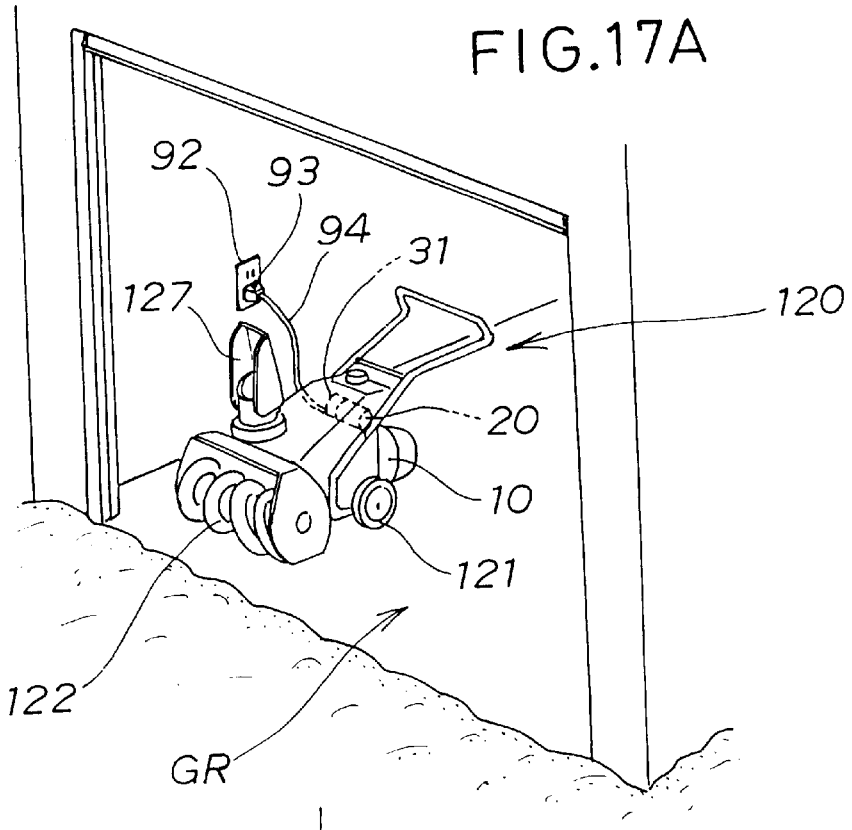
FIGS. 17A and 17B are diagrammatical views illustrative of the operation of the snowplow.
Figure 17B:
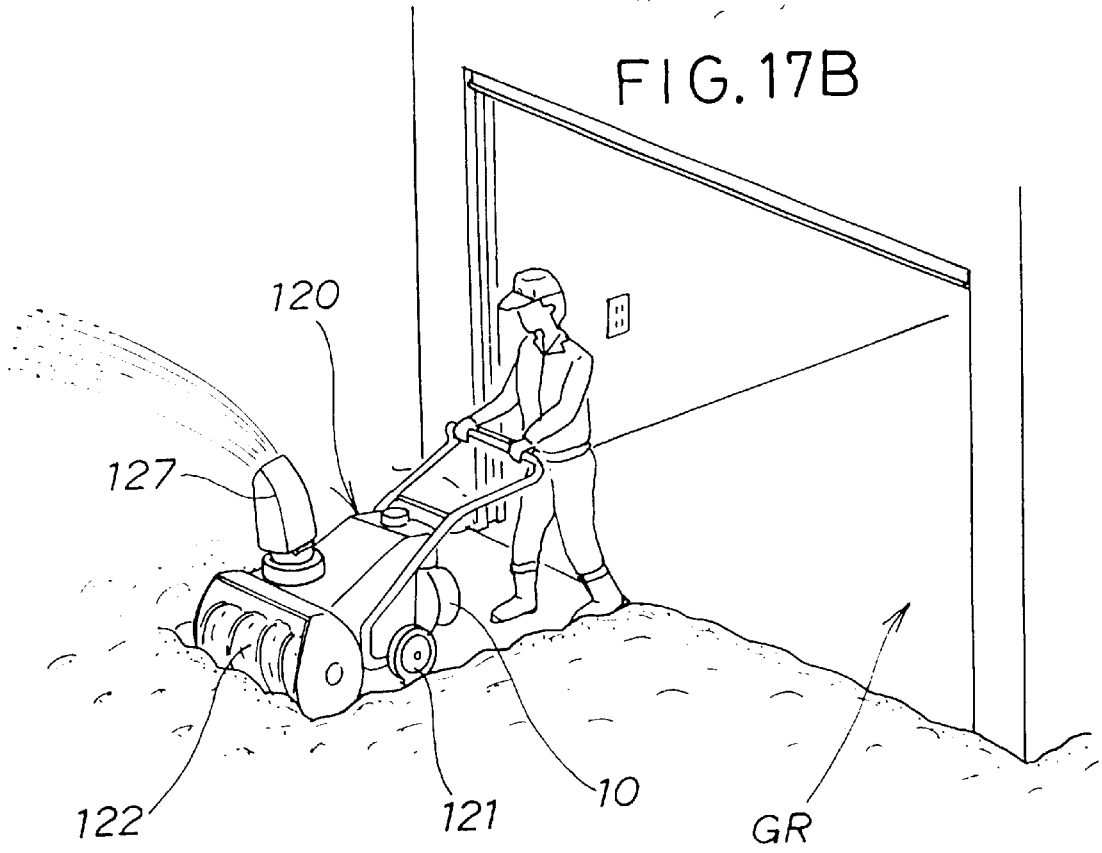

The snowplow 120 is normally stored in a garage GR, as shown in FIG. 17A. When the snowplow 120 is to be used, a plug connector 93 is inserted into a plug receptacle 92 provided at the garage GR as an outlet of a.c. power source. Then, the non-illustrated start button is depressed to start the self-starting motor 31. The self-starting motor 31 operates to rotate the crankshaft of the engine 10 until the engine fires and continues to run on its own power. When the engine 10 starts to run on its own power, the start button is depressed again to stop the self-starting motor 31, and the plug connector 93 is removed from the plug receptacle 92.

Then, the wheels 121 of the snowplow 120 are rotated to move the snowplow 120 forward until the snowplow 120 goes out from the garage GR. The operator then properly maneuvers the snowplow 121 so that the snow deposited on a road or a field is cleared away or removed by the snowplow attachment 122.

For the motor starting device 20 used with the snowplow 120, the motor drive circuit 90 (FIG. 15) that can be used with an a.c. power source is advantageous over any of the motor control circuits driven by a battery because the a.c. powered motor drive circuit can readily activate the self-starting motor 31 regardless of the length of a non-use period of the snowplow 120.

Figure 18:
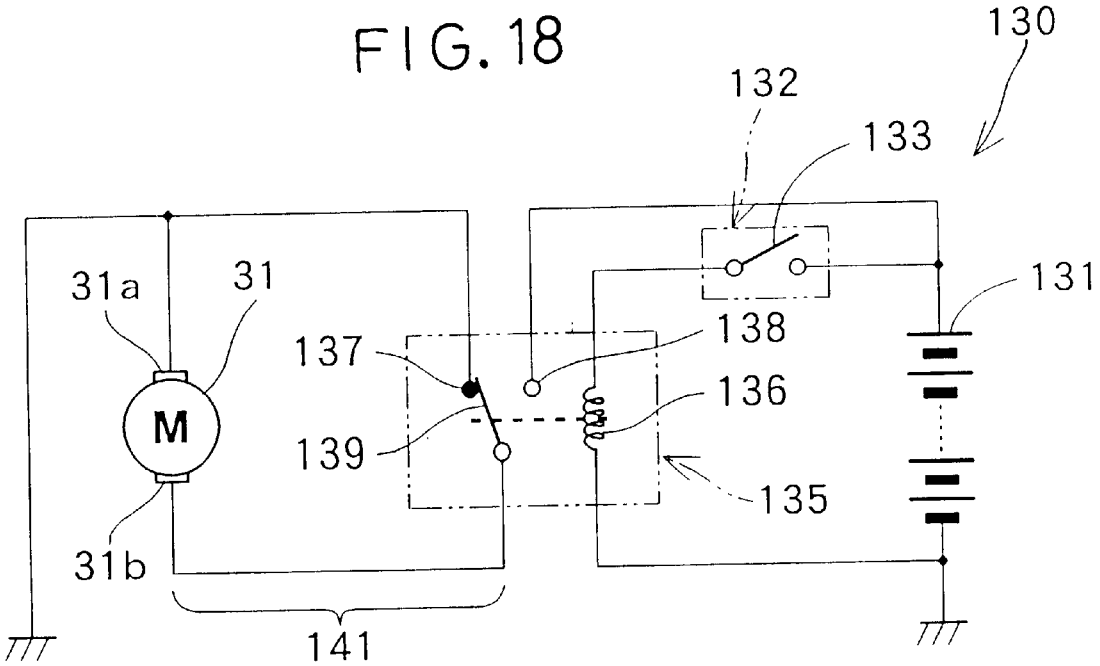
FIG. 18 is a circuit diagram showing a motor drive circuit according to a modification of the present invention.
Figure 19A:
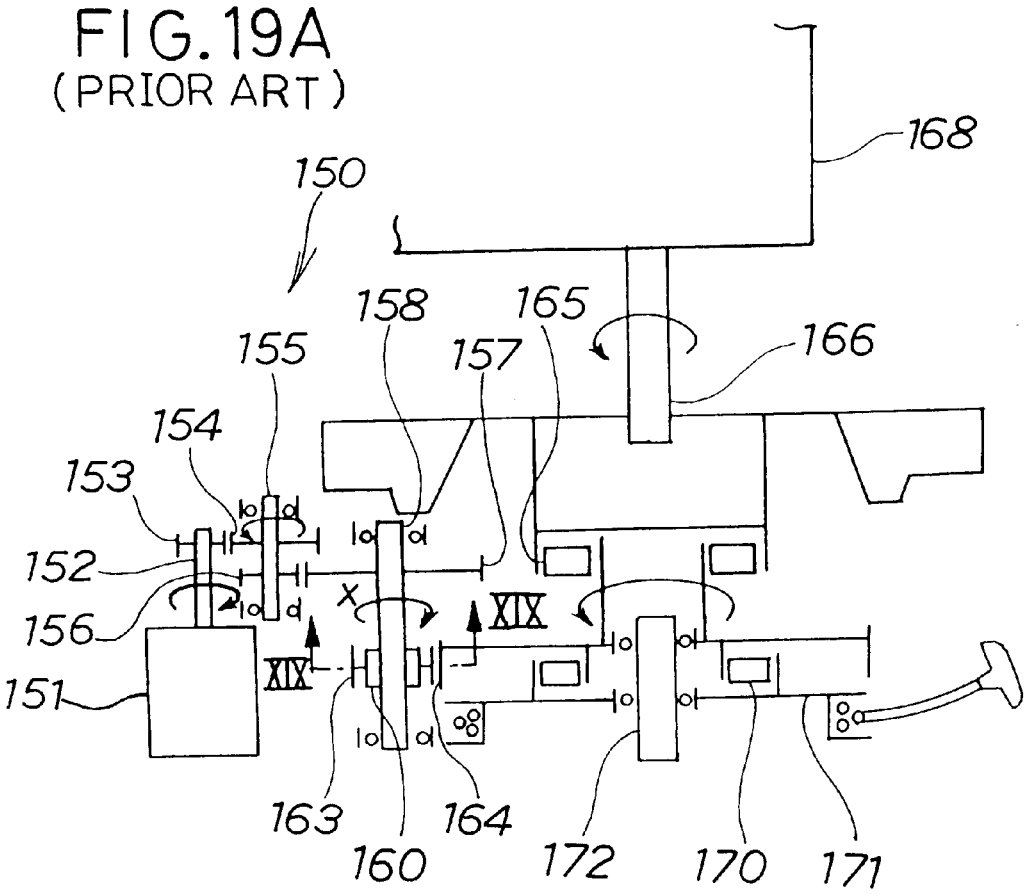
FIG. 19A (PRIOR ART)
FIG. 19A is a diagrammatical view showing a conventional engine starting device when activated by using a self-starter mechanism.
Figure 19B:
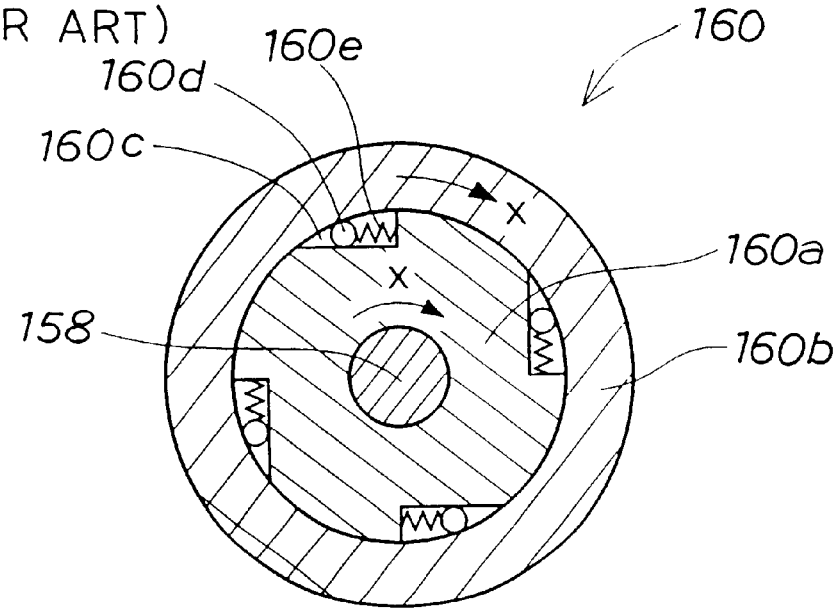
FIG. 19B (PRIOR ART)
FIG. 19B is an enlarged cross-sectional view taken along line XIX—XIX of FIG. 19A.
Figure 20A:
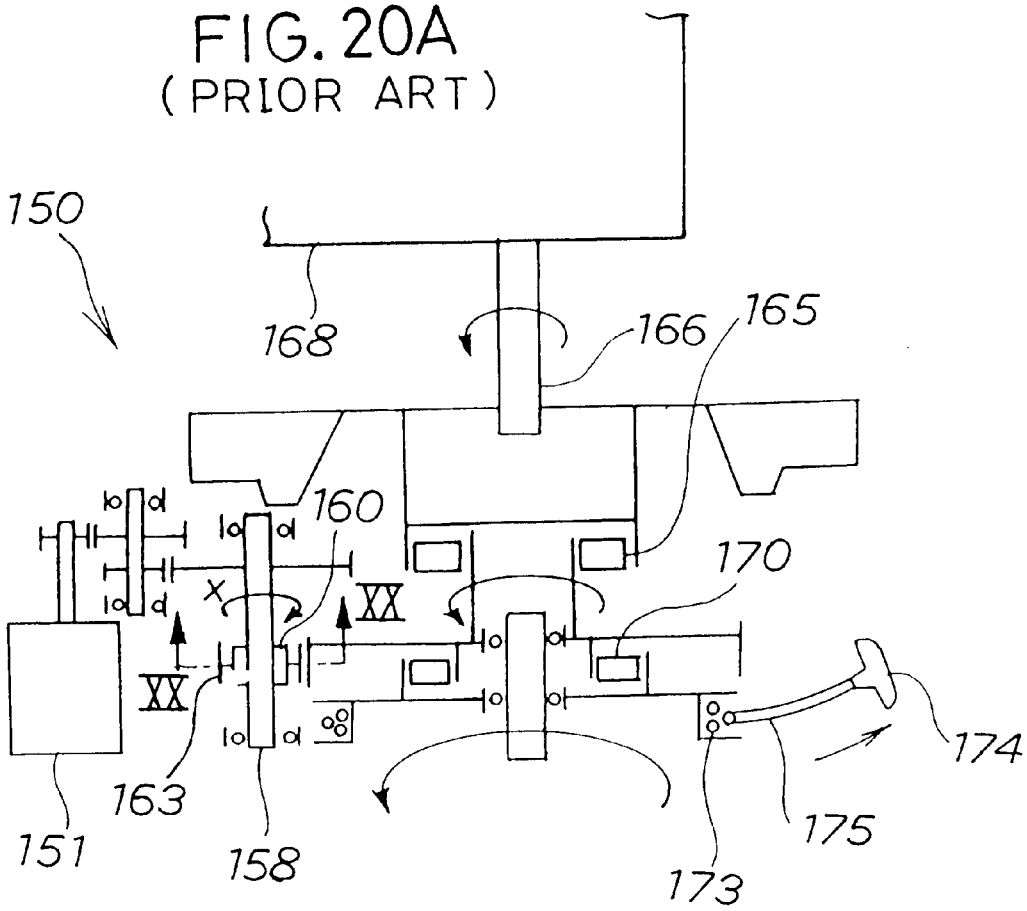
FIG. 20A (PRIOR ART)
FIG. 20A is a view similar to FIG. 19A, showing the conventional engine starting device when activated by using a recoil starter mechanism.
Figure 20B:
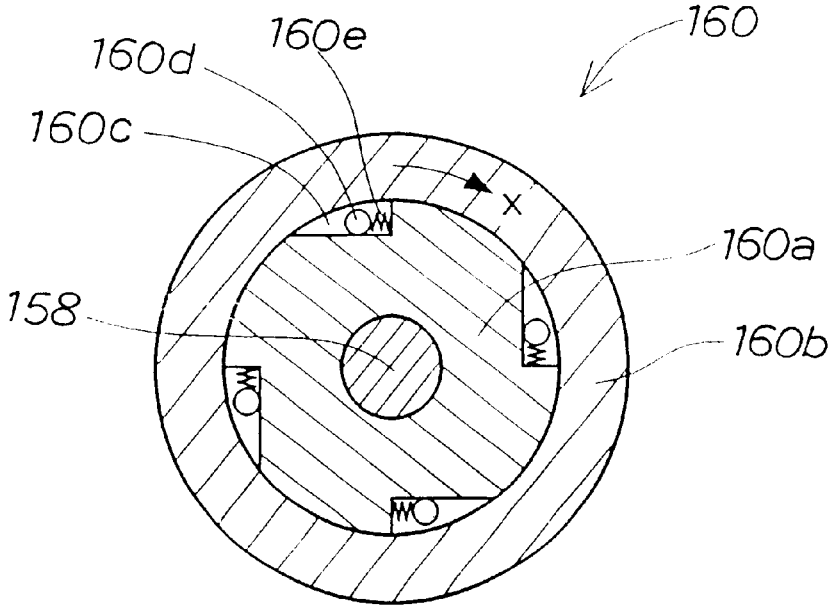
FIG. 20B (PRIOR ART)
FIG. 20B is an enlarged cross-sectional view taken along line XX—XX of FIG. 20A.
Figure 21A:
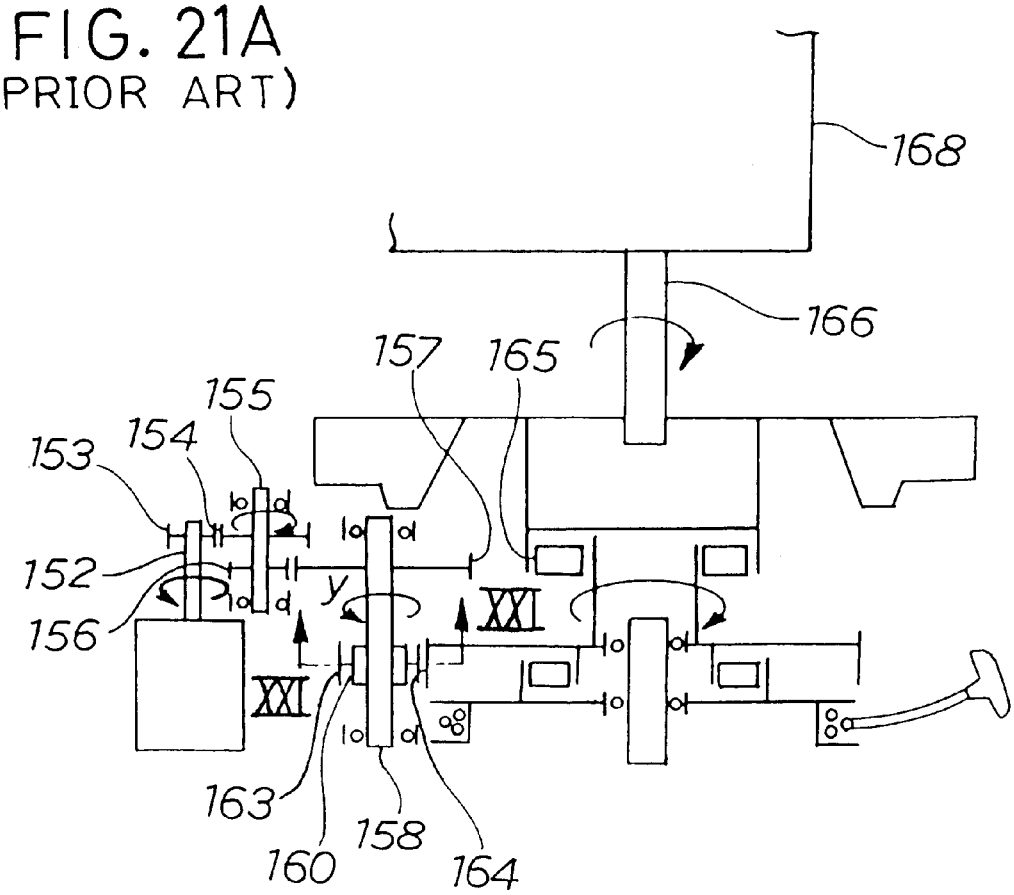
FIG. 21A (PRIOR ART)
FIG. 21A is a view similar to FIG. 19A, showing a problem of the conventional engine starting device caused when the crankshaft of an engine is rotated in the reverse direction.
Figure 21B:
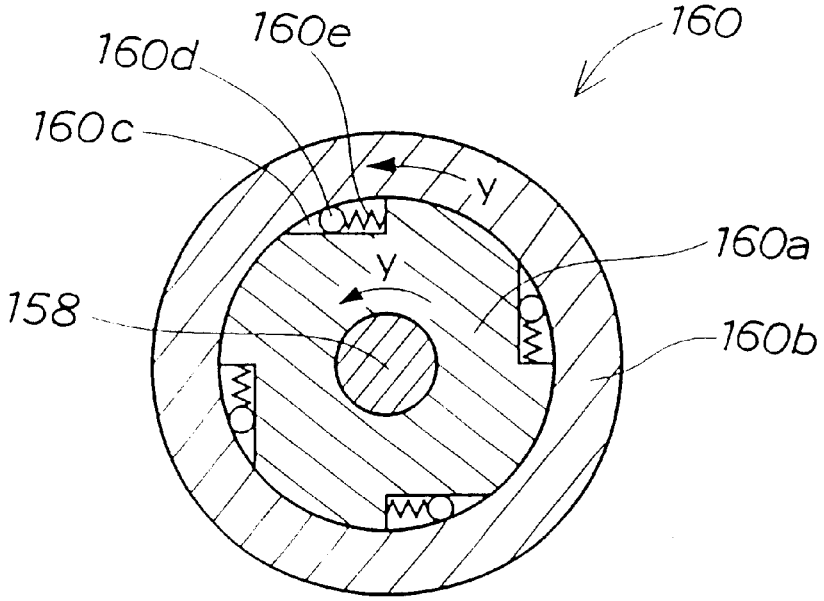
FIG. 21B (PRIOR ART)
FIG. 21B is an enlarged cross-sectional view taken along line XXI—XXI of FIG. 21A.

FIG. 18 shows a modified form of the motor drive circuit according to the present invention. The modified motor drive circuit 130 differs from the motor drive circuit 90 of FIG. 15 in that it is powered by a d.c. source such as a battery 131. The battery-powered motor drive circuit 130 includes a start switch 132 and a relay 135 operatively interconnect the battery 131 and the self-starting motor 31. When the start switch 132 is turned on or activated, d.c. power from the battery 131 is supplied via the relay 135 to the self-starting motor 31 across the terminals 31*a*, 31*b*. The motor drive circuit 130 further has a short circuit 141 which, when the start switch 132 is turned off or deactivated, is made or completed to short-circuit the terminals 31*a* and 31*b* of the self-starting motor 31.

The start switch 132 is a push-button switch of the type including a normally open contact 133 that is closed only when a non-illustrated start button is depressed. The relay 135 includes an exciting coil 136, a normally closed contact 137, a normally open contact 138, and a movable contact 138 which is normally held in contact with the normally closed contract 137 is movable into contact with the normally open contact 138 when the exciting coil 136 is energized.

The exciting coil 136 of the relay 135 is connected to positive and negative terminals of the battery via the normally open contact 133 of the start switch 132. The normally open contact 137 is connected to the positive terminal of the battery 131. The normally closed contact 137 is connected to the terminal 31*a* of the self-starting motor 31 and also to the ground. The movable contact 139 is connected to the terminal 31*b* of the self-starting motor 31. The short circuit 141 includes the self-starting motor 31 and is closed or completed when the movable contact 139 comes into contact with the normally closed contact 137.

The motor drive circuit 130 of the foregoing arrangement operates as follows.

When the operator depresses the start button (not shown) to activate the start switch 132 (FIG. 18), the normally open contact 133 is closed, thereby energizing the exciting coil 136 of the relay 135. By thus energizing the exciting coil 136, the movable contact 193 moves into contact with the normally open contact 138 to thereby activate the relay 135. Thus, d.c. power from the battery 131 is supplied across the terminals 31*a* and 31*b* so that the self-starting motor 31 is energized. The self-starting motor 31 rotates the crankshaft of the engine 10 (FIG. 1) until the engine fires and continues to run on its own power in the manner as described above.

When the engine 10 starts to run on its own power, the non-illustrated start button is depressed again to deactivate the start switch 132. With this depression of the start button, the normally open contact 133 is opened whereupon the exciting coil 136 is de-energized. The movable contact 139 is released from the normally open contact 138 so that the relay 135 is deactivated. Thus the supply of d.c. power from the battery 131 to the self-starting motor 31 is stopped. The movable contact 139 is allowed to return to its original position, closing the normally closed contact 137 whereupon the terminals 31*a* and 31*b* of the self-starting motor 31 are short-circuited. By thus shorting the motor terminals 31*a*, 31*b*, a dynamic braking is created in which the retarding force is supplied by the same machine (self-starting motor 31) that originally was the driving motor. Thus, the self-starting motor 31 can be stopped suddenly by the effect of a braking action resulting from a counter electromotive force.

Since the self-starting motor 31 comes to a sudden stop, the centrifugal force acting on the ratchet pawls (FIG. 12C) is killed suddenly. Thus, the ratchet pawls 44 are allowed to rapidly return to their original released position of FIG. 12A under the force of the torsion coil springs 46. With this rapid returning of the ratchet pawls 44, the one-way clutch 40 can be disengaged or released without causing interference or collision between the ratchet pawls 44 and the ratchet teeth 48 which would otherwise result in the generation of striking noise and vibrations.

Obviously, various minor changes and modifications of the present invention are possible in the light of the above teaching. It is therefor to be understood that within the scope of the appended claims the present invention may be practiced otherwise than as specifically described.

What is claimed is:

1. An engine starting device for rotating a crankshaft of an engine to start the engine, comprising:

a self-starting motor drivable to rotate the crankshaft of the engine; and a one-way clutch disposed between said self-starting motor and the crankshaft of the engine and operable to transmit rotary motion of said self-starting motor to the crankshaft, said one-way clutch including an inner race operatively connected to an output shaft of said self-starting motor for co-rotation therewith, an outer race concentric to said inner race and operatively connected to the crankshaft, a plurality of ratchet pawls pivotally connected to said inner race for pivotal movement within an annular space defined between said inner race and said outer race, and a plurality of springs acting between said inner race and said ratchet pawls and urging said ratchet pawls against said inner race to thereby keep said ratchet pawls out of contact with said outer race, wherein when the speed of rotation of said inner race while being rotated by said self-starting motor goes up to a predetermined value, said ratchet pawls are caused to swing in a radial outward direction under the action of centrifugal force against the force of said springs and become engaged by said outer race to thereby engage said one-way clutch.

2. An engine starting device according to claim 1, wherein said outer race has a plurality of ratchet teeth formed on an inner circumferential surface of said outer race, said ratchet teeth being lockingly engageable with respective free ends of said ratchet pawls.

3. An engine starting device according to claim 2, wherein the number of said ratchet teeth is at least equal to the number of said ratchet pawls.

4. An engine starting device according to claim 2, wherein the number of said ratchet teeth is an integral multiple of the number of said ratchet pawls.

5. An engine starting device according to claim 1, wherein each of said ratchet pawls includes a pivot shaft rotatably supported at opposite ends thereof to said inner race.

6. An engine starting device according to claim 5, wherein said inner race has a plurality of axial holes formed therein and spaced at equal circumferential intervals about the center of said inner race, each of said axial holes rotatably receiving therein one of said opposite ends of said pivot shaft, and wherein said one-way clutch further includes a support plate attached to said inner race, said support plate having a plurality of holes axially aligned with said axial holes in said inner race, each of said holes in said support plate rotatably receiving therein the other end of said pivot shaft.

7. An engine starting device according to claim 1, further including a torque limiter assembled on said output shaft of said self-starting motor for protecting said self-starting motor against overload, said torque limiter being designed to automatically slip at a predetermined torque.

8. An engine starting device according to claim 7, wherein said torque limiter comprises an inner race rotatable mounted on said output shaft of said self-starting motor, a plurality of lock pins partly received in a plurality of axial grooves, respectively, formed in an outer circumferential surface of said inner race, a bias member for urging said lock pins into said axial grooves, and an outer race concentric to said inner race and firmly connected to said output shaft of said self-starting motor, said outer race having a plurality of axial grooves formed in an inner circumferential surface thereof for receiving respectively therein at least a part of said locking pins, said axial grooves of said outer race having a depth large enough to fully accommodate therein said lock pins.

9. An engine starting device according to claim 8, wherein said axial grooves of said inner race have a generally V-shaped cross section, and said axial grooves of said outer race have a generally U-shaped cross section.

10. An engine starting device according to claim 8, wherein said bias member is a resilient ring wound around said lock pins and resiliently urging the lock pins in a radial inward direction.

11. An engine starting device according to claim 10, wherein said lock pins each have a circumferentially grooved central portion, and said resilient ring is partly received in the respective circumferentially grooved central portions of said lock pins.

12. An engine starting device according to claim 11, wherein said outer race further has a circumferential groove formed in said inner circumferential surface thereof for receiving therein part of said resilient ring.

13. An engine starting device according to claim 10, wherein said resilient ring comprises a coiled ring spring.

14. An engine starting device according to claim 1, further including a motor drive circuit for driving said self-starting motor, wherein said motor drive circuit includes a start switch adapted to be turned on and off to electrically connect and disconnect said self-starting motor with a source of electric power for energizing and de-energizing said self-starting motor, and a short circuit formed across terminals of said self-starting motor when said start switch is turned off.

15. An engine starting device according to claim 14, wherein said source of electric power is an a.c. power source.

16. An engine starting device according to claim 15, wherein said self-starting motor is a d.c. motor, and said motor control circuit further includes a power circuit for converting a.c. voltage to d.c. voltage.

17. An engine starting device according to claim 15, wherein said engine starting device is incorporated in an engine installed in an engine-driven snowplow.

* * * * *